US012104883B2

(12) United States Patent
Richardson et al.

(10) Patent No.: US 12,104,883 B2
(45) **Date of Patent: *Oct. 1, 2024**

(54) RELEASABLY ENGAGABLE SYSTEM OF BALLISTIC-RESISTANT PANELS

(71) Applicant: Angel Armor, LLC, Fort Collins, CO (US)

(72) Inventors: Joshua Michael Richardson, Windsor, CO (US); Matthew Jason Wellman, Fort Collins, CO (US); Christopher R. Foth, Windsor, CO (US)

(73) Assignee: Angel Armor, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/671,602

(22) Filed: Nov. 1, 2019

(65) Prior Publication Data

US 2020/0064105 A1 Feb. 27, 2020

Related U.S. Application Data

(63) Continuation of application No. 15/665,207, filed on Jul. 31, 2017, now Pat. No. 10,466,015, which is a (Continued)

(51) Int. Cl.

| | |
|---|---|
| ***F41H 5/04*** | (2006.01) |
| ***F41H 1/02*** | (2006.01) |
| ***F41H 5/013*** | (2006.01) |

(52) U.S. Cl.

CPC ..... *F41H 5/013* (2013.01); *F41H 1/02* (2013.01); *F41H 5/0414* (2013.01); *F41H 5/0428* (2013.01)

(58) Field of Classification Search

CPC ... F41H 5/00; F41H 5/013; F41H 5/04; F41H 5/0414; F41H 5/0428; F41H 1/00; F41H 1/02

(Continued)

(56) References Cited

U.S. PATENT DOCUMENTS 2,135,118 A 11/1938 Stewart
3,859,892 A 1/1975 Coes
(Continued)

FOREIGN PATENT DOCUMENTS

WO 2011/141172 11/2011

OTHER PUBLICATIONS

Global News. Saving Lives at Kelowna's PRE Labs Inc. Article by T. Lowe, published Aug. 2, 2018. Website, https://globalnews.ca/news/436850/saving-lives-at-kelownas-pre-labs-inc/, originally downloaded Apr. 8, 2020, 3 pages.

(Continued)

*Primary Examiner* — Jonathan C Weber
(74) *Attorney, Agent, or Firm* — Craig R. Miles; CR MILES P.C.

(57) ABSTRACT

Disclosed herein are embodiments of a releasably engagable system of ballistic-resistant panels including a first ballistic-resistant panel comprising a ceramic plate system, the first ballistic-resistant panel having opposing first ballistic-resistant panel front and back surfaces; and a second ballistic-resistant panel having opposing second ballistic-resistant panel front and back surfaces. Additionally, the embodiments of the releasably engagable systems of ballistic-resistant panels include at least one of fasteners, an adhesive coating, or a securement element, all of which function to releasably engage the second ballistic-resistant panel front surface with the first ballistic-resistant panel back surface in fixed adjacent relation to provide releasably engaged ballistic-resistant panels.

16 Claims, 23 Drawing Sheets

Related U.S. Application Data continuation-in-part of application No. 15/407,155, filed on Jan. 16, 2017, now Pat. No. 10,495,418.

(60) Provisional application No. 62/279,202, filed on Jan. 15, 2016, provisional application No. 62/278,811, filed on Jan. 14, 2016.

(58) Field of Classification Search
USPC ..... 89/36.01, 36.02, 36.05, 36.07, 36.08; 109/49.5
See application file for complete search history.

(56) References Cited

U.S. PATENT DOCUMENTS 3,962,976 A 6/1976 Kelsey
4,167,889 A 9/1979 Bohne et al.
4,911,061 A 3/1990 Pivitt et al.
4,928,575 A 5/1990 Smirlock et al.
5,083,515 A 1/1992 Seksaria et al.
5,170,690 A 12/1992 Smirlock et al.
5,185,195 A * 2/1993 Harpell ..... B32B 7/09 2/2.5
5,191,166 A 3/1993 Smirlock et al.
5,198,280 A * 3/1993 Harpell ..... F41H 5/0435 428/113
5,327,811 A * 7/1994 Price ..... F41H 1/02 2/2.5
5,333,532 A 8/1994 Smirlock et al.
5,463,929 A * 11/1995 Mejia ..... F41H 5/0457 109/82
5,560,971 A * 10/1996 Emery ..... B32B 5/26 428/92
5,792,974 A 8/1998 Daqis et al.
5,996,115 A 12/1999 Mazelsky
6,035,438 A 3/2000 Neal et al.
6,319,862 B1 * 11/2001 Czetto, Jr. ..... B32B 5/26 428/102
6,786,126 B2 * 9/2004 Sargent ..... F41H 5/0485 2/2.5
6,807,891 B2 10/2004 Fisher
7,458,306 B2 12/2008 Singh et al.
8,267,001 B2 9/2012 Sayre et al.
8,757,042 B2 6/2014 Pfister
9,003,946 B2 * 4/2015 Daley ..... F41H 5/0464 89/36.05
2003/0192426 A1 10/2003 Peretz
2003/0221547 A1 12/2003 Peretz
2004/0144244 A1 * 7/2004 Sargent ..... F41H 5/0485 89/36.02
2005/0066805 A1 * 3/2005 Park ..... F41H 5/0464 89/36.02
2006/0248623 A1 * 11/2006 Miller ..... F41H 1/04 2/6.6
2007/0105471 A1 * 5/2007 Wang ..... F41H 5/0471 428/902
2007/0234895 A1 10/2007 Singh et al.
2008/0236378 A1 * 10/2008 Sane ..... F41H 5/0492 89/36.02
2009/0095147 A1 * 4/2009 Tunis ..... F41H 5/013 89/36.02
2009/0133571 A1 5/2009 Pfister
2010/0043630 A1 2/2010 Sayre et al.
2011/0192274 A1 8/2011 Fingerhut
2012/0186426 A1 7/2012 Ward et al.
2015/0253114 A1 9/2015 Neal
2015/0268009 A1 9/2015 Tunis, III et al.
2016/0102950 A1 * 4/2016 Strauss ..... B32B 7/02 89/36.02

OTHER PUBLICATIONS

U.S. Appl. No. 62/278,811, filed Jan. 14, 2016.
U.S. Appl. No. 62/279,202, filed Jan. 15, 2016.
U.S. Appl. No. 15/407,155, filed Jan. 16, 2017.
U.S. Appl. No. 15/451,225, filed Mar. 6, 2017.
U.S. Appl. No. 15/665,207, filed Jul. 31, 2017.
TenCate Advanced Armor. TenCate Multi-light™ CXP-461 IC Torso. Website, https://www.tencateadvancedarmor.com/personal-protection/Body-armor-plates/TenCate-Multi-light-hard-body-armor-plates/4Tpr/TenCate-Multi-light-CXP-461-IC-Torso, originally downloaded Feb. 25, 2019, one page.

* cited by examiner 5
12/49/51
8/10
1/4

11/49/50
8
10
5/35
6/37
5/13/16

5/13/16
5/35
6/37

5/6/13/16/37

5/13/16

6/34/37
5/13/16
49

15
20
18
27/31
27/32
34
28/30
29/33
14
5/13/16

6/34/37
5/13/16

6/34/37

6/34/37
5/13/16

5/13/16
6/34/37

46/76
8/10
46/74
46/77
46/75

46/74

10

9
8
46/77
46/75

8/46/74
46/77
12/49/51
9
10
46/76
12/49/51

12/49/51
46/77
47
12/49/51
46/74
12/49/51
46/76
8/9
12/49/51
46/75

12/49/51
46/77
8/46/75
9
10
12/49/51
46/76

9
46/74
8
10
46/76
46/75

RELEASABLY ENGAGABLE SYSTEM OF BALLISTIC-RESISTANT PANELS

This United States Patent Application is a continuation of U.S. patent application Ser. No. 15/665,207, filed Jul. 31, 2017, now U.S. Pat. No. 10,466,015, issued Nov. 5, 2019, which is a continuation-in-part of U.S. patent application Ser. No. 15/407,155, filed Jan. 16, 2017, now U.S. Pat. No. 10,495,418, issued Dec. 3, 2019, which claims the benefit of U.S. Provisional Patent Application No. 62/279,202 filed Jan. 15, 2016 and U.S. Provisional Patent Application No. 62/278,811 filed Jan. 14, 2016, each hereby incorporated by reference herein.

I. SUMMARY OF THE INVENTION

A broad object of a particular embodiment of the invention can be to provide a releasably engagable system of ballistic-resistant panels, and methods of making and using such a releasably engagable system of ballistic-resistant panels, whereby the releasably engagable system of ballistic-resistant panels includes a first ballistic-resistant panel comprising a ceramic plate system, the first ballistic-resistant panel having opposing first ballistic-resistant panel front and back surfaces; and a second ballistic-resistant panel having opposing second ballistic-resistant panel front and back surfaces. Additionally, the releasably engagable system of ballistic-resistant panels includes at least one of fasteners, an adhesive coating, or a securement element, all of which function to releasably engage the second ballistic-resistant panel front surface with the first ballistic-resistant panel back surface in fixed adjacent relation to provide releasably engaged ballistic-resistant panels.

Naturally, further objects of the invention are disclosed throughout other areas of the specification, drawings, and claims.

II. BRIEF DESCRIPTION OF THE DRAWINGS

Figure 11:
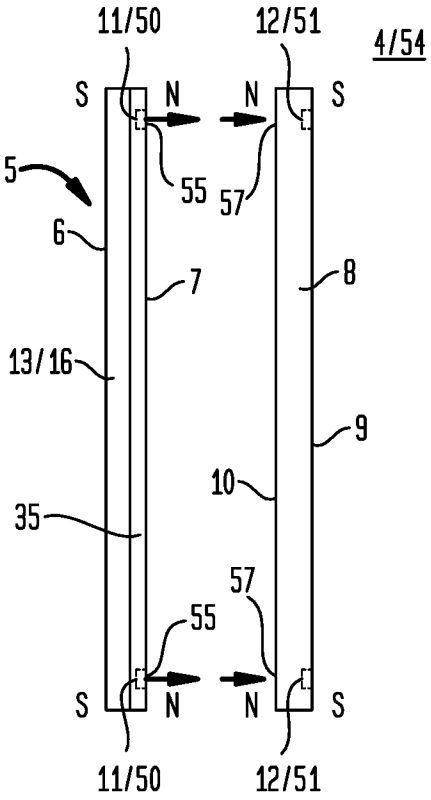

FIG. 11 is a side view of a particular embodiment of the releasably engagable system of ballistic-resistant panels having first and second magnets which are directional to allow fastening in a first configuration and preclude fastening in a second configuration, whereby first and second ballistic-resistant panels cannot releasably engage because the first and second ballistic-resistant panels dispose in the second configuration.

Figure 12B:
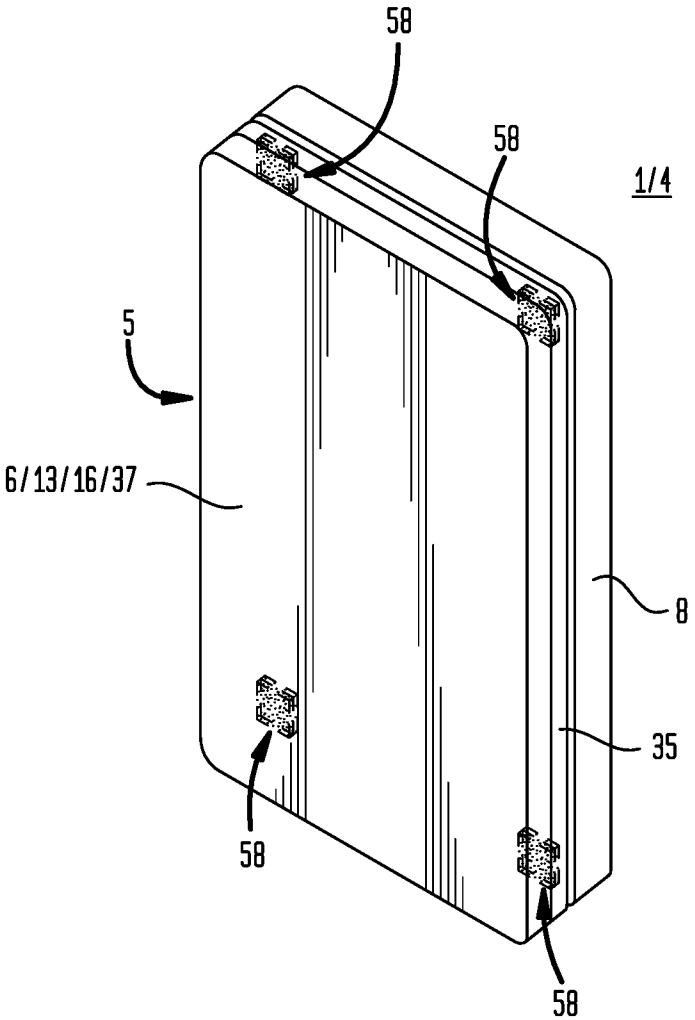
Figure 12A:
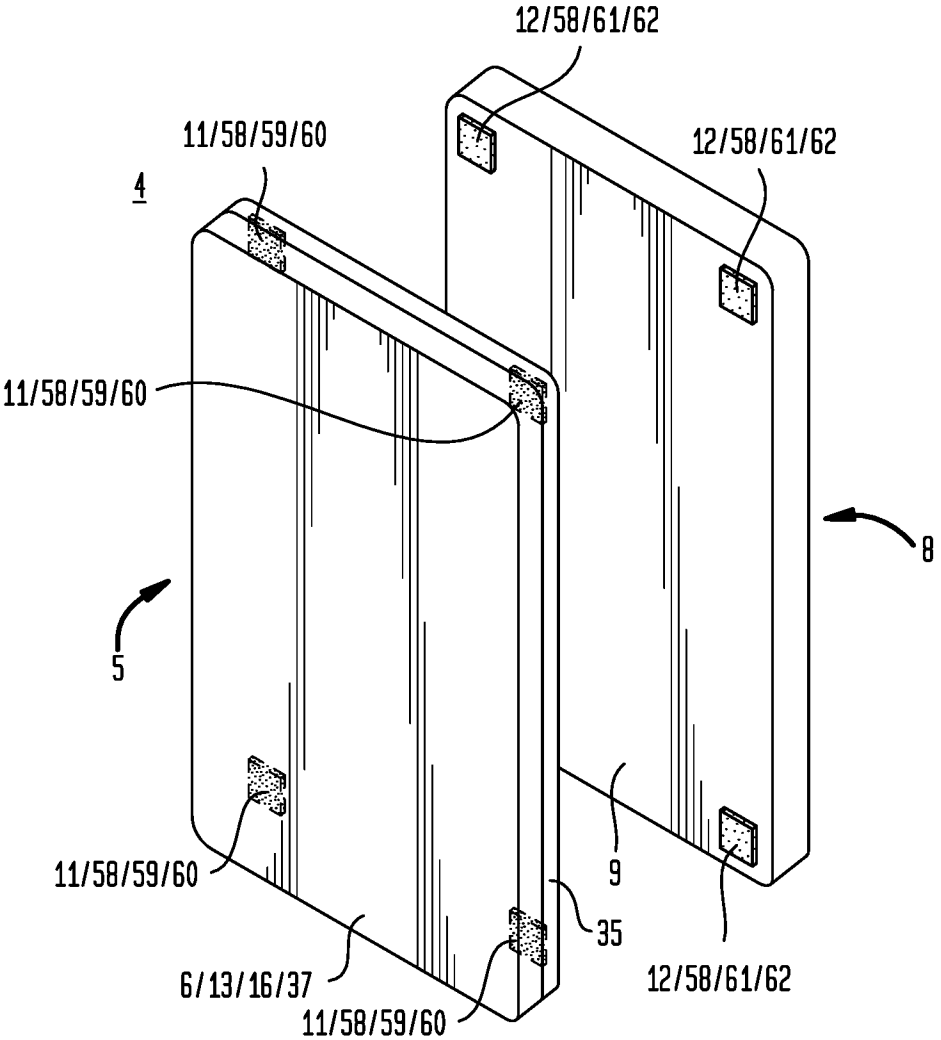

FIG. 12A is a perspective view of a particular embodiment of the releasably engagable system of ballistic-resistant panels having first and second fasteners configured to provide a hook and loop fastening system, whereby first and second ballistic-resistant panels are not releasably engaged in fixed adjacent relation.

FIG. 12B is a perspective view of the first and second ballistic-resistant panels shown in FIG. 12A, but whereby the first and second ballistic-resistant panels are releasably engaged in fixed adjacent relation to provide releasably engaged ballistic-resistant panels.

Figure 13B:
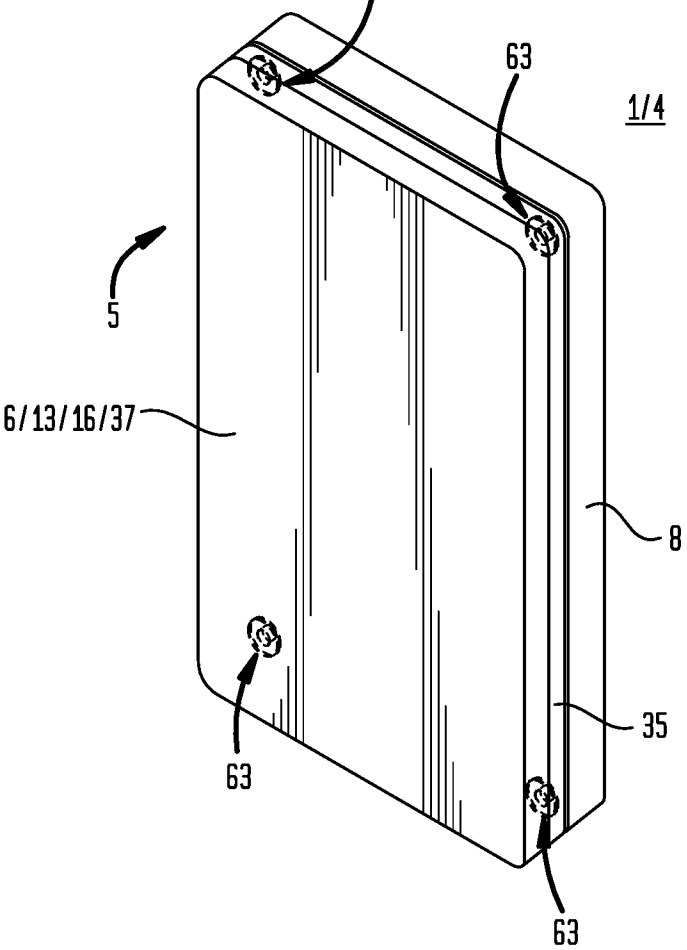
Figure 13A:
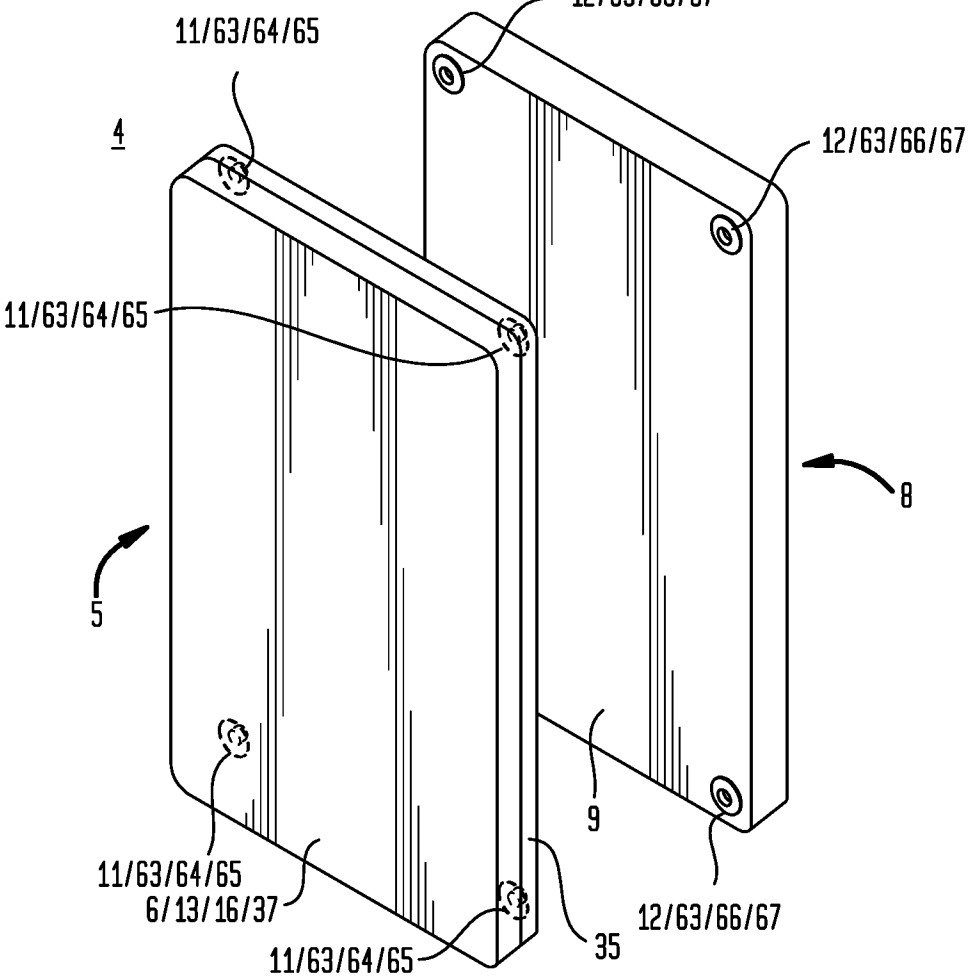

FIG. 13A is a perspective view of a particular embodiment of the releasably engagable system of ballistic-resistant panels having first and second fasteners configured to provide a post-and-socket fastening system, whereby first and second ballistic-resistant panels are not releasably engaged in fixed adjacent relation.

FIG. 13B is a perspective view of the first and second ballistic-resistant panels shown in FIG. 13A, but whereby the first and second ballistic-resistant panels are releasably engaged in fixed adjacent relation to provide releasably engaged ballistic-resistant panels.

Figure 14B:
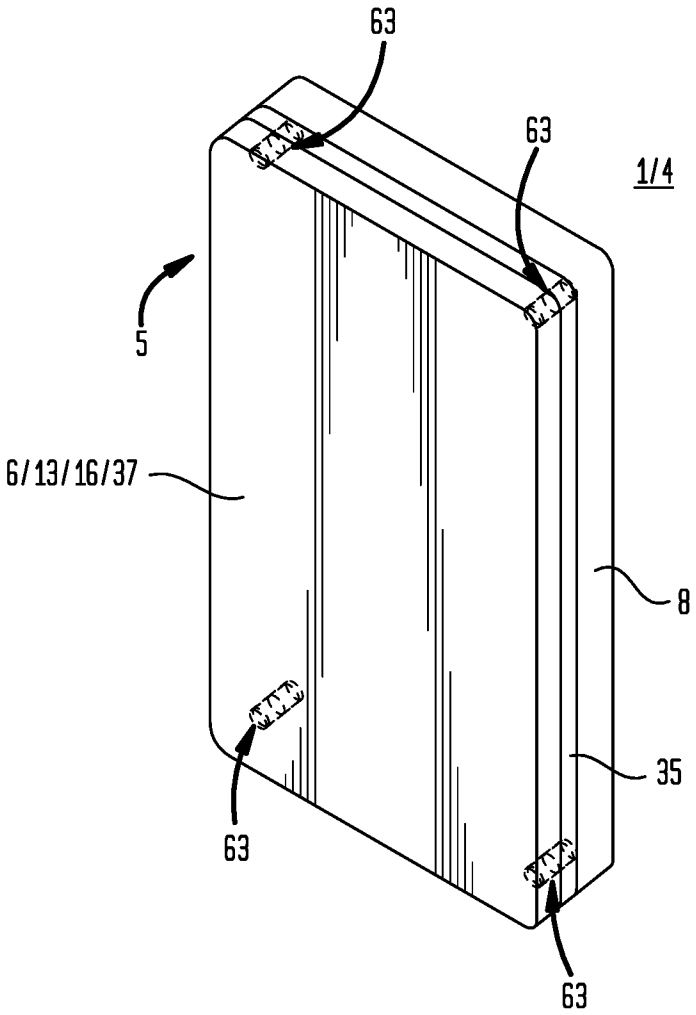
Figure 14A:
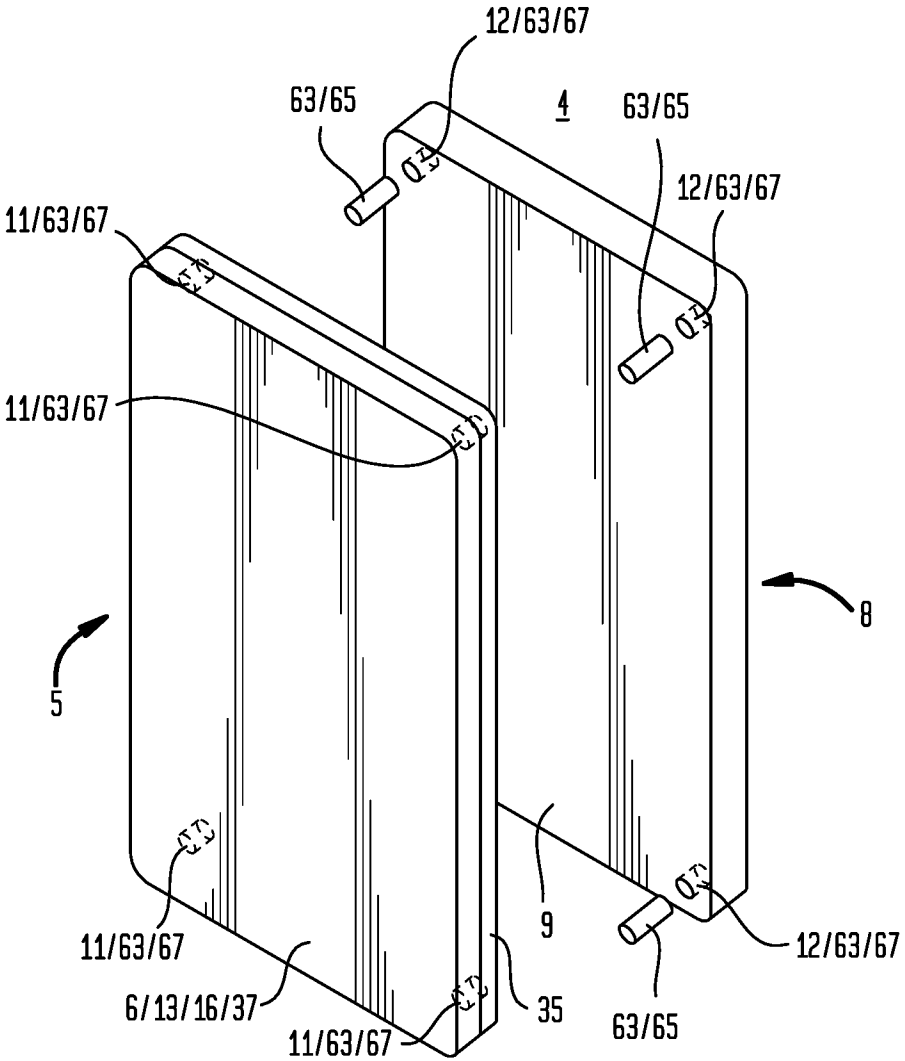

FIG. 14A is a perspective view of a particular embodiment of the releasably engagable system of ballistic-resistant panels having first and second fasteners configured to provide a post-and-socket fastening system, whereby first and second ballistic-resistant panels are not releasably engaged in fixed adjacent relation.

FIG. 14B is a perspective view of the first and second ballistic-resistant panels shown in FIG. 14A, but whereby the first and second ballistic-resistant panels are releasably engaged in fixed adjacent relation to provide releasably engaged ballistic-resistant panels.

Figure 15B:
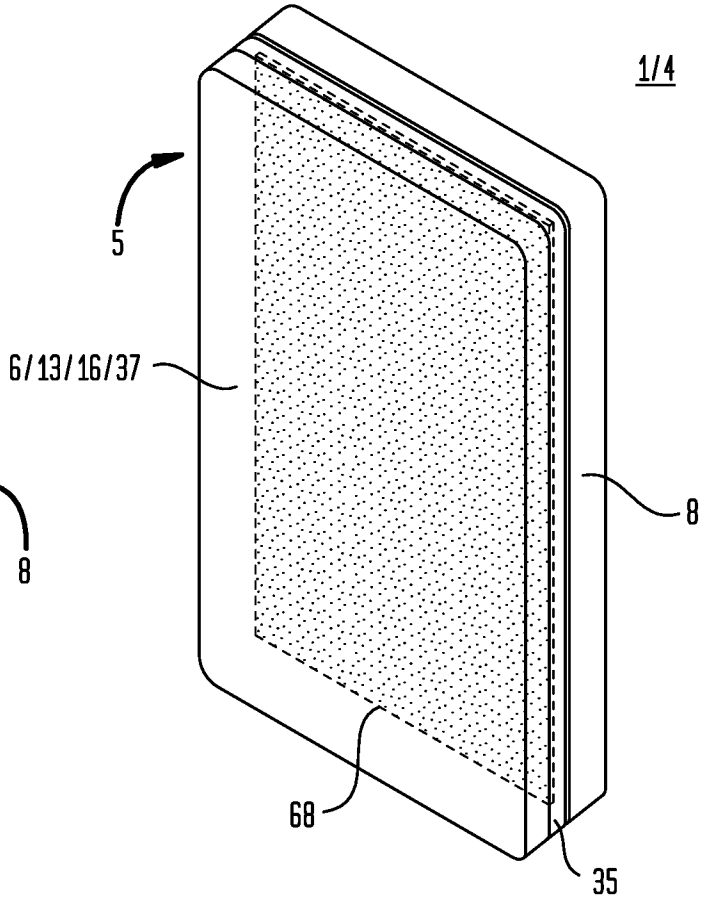
Figure 15A:
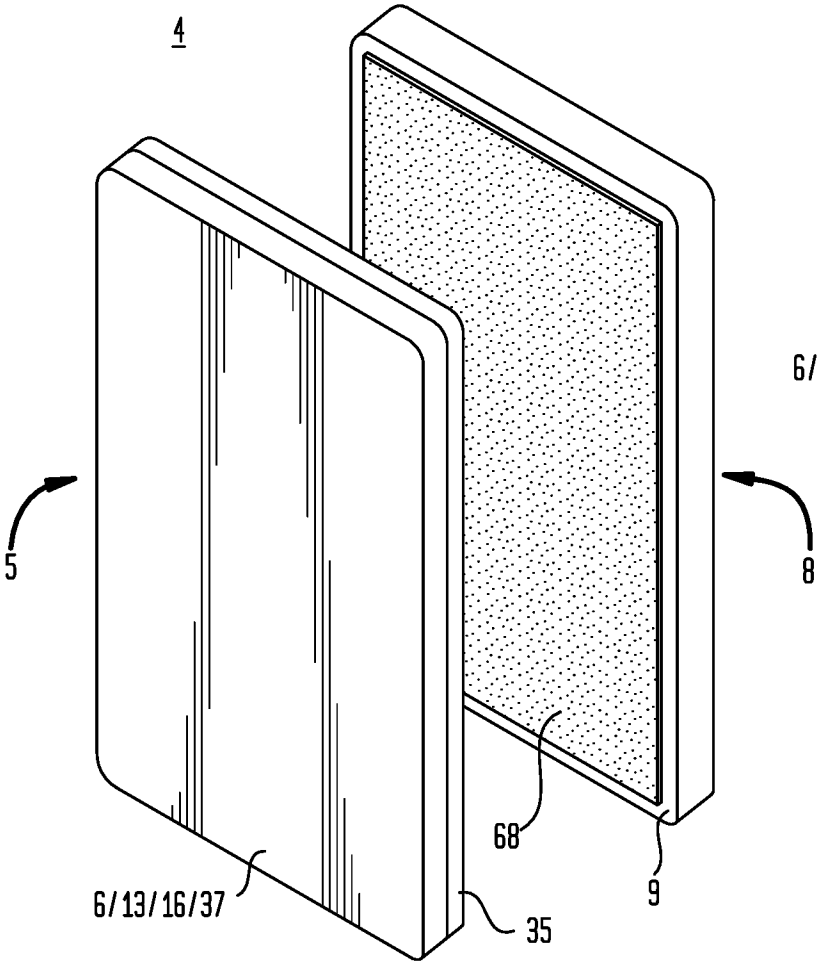

FIG. 15A is a perspective view of a particular embodiment of the releasably engagable system of ballistic-resistant panels having an adhesive coating coupled to a second ballistic-resistant panel front surface, whereby first and second ballistic-resistant panels are not releasably engaged in fixed adjacent relation.

FIG. 15B is a perspective view of the first and second ballistic-resistant panels shown in FIG. 15A, but whereby the first and second ballistic-resistant panels are releasably engaged in fixed adjacent relation to provide releasably engaged ballistic-resistant panels.

Figure 16B:
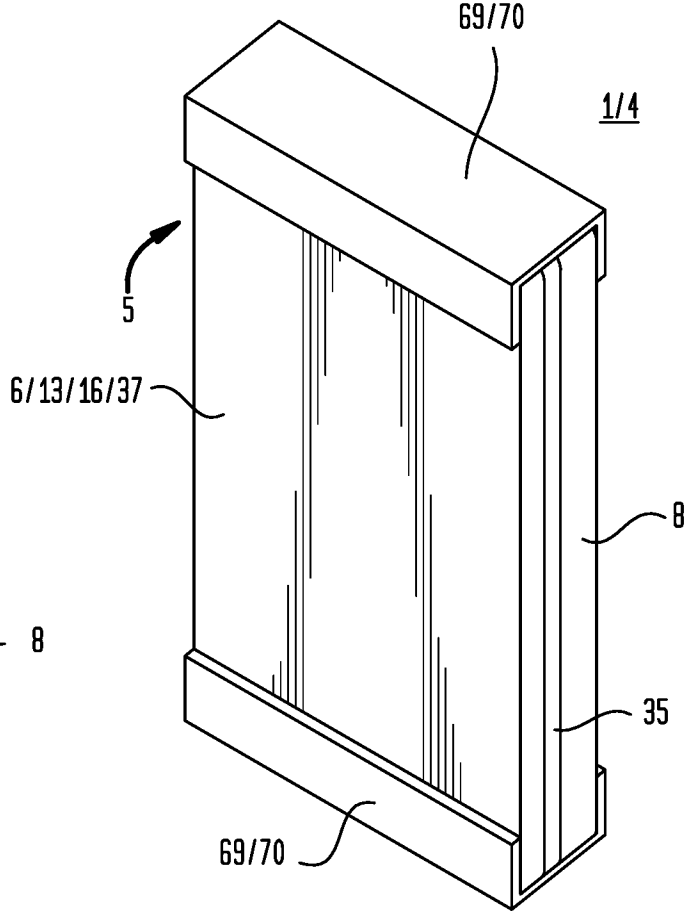
Figure 16A:
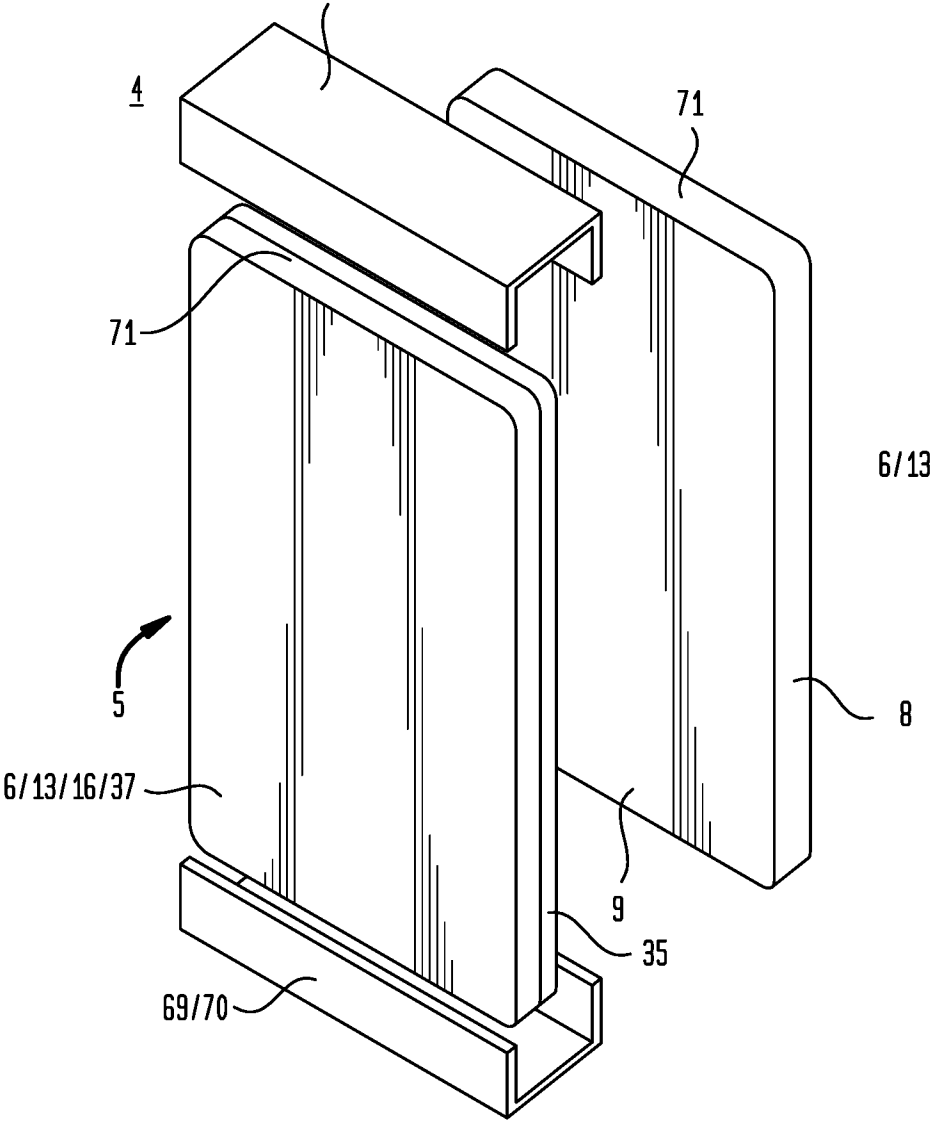

FIG. 16A is a perspective view of a particular embodiment of the releasably engagable system of ballistic-resistant panels having a securement element configured as a channel, whereby first and second ballistic-resistant panels are not releasably engaged in fixed adjacent relation.

FIG. 16B is a perspective view of the first and second ballistic-resistant panels shown in FIG. 16A, but whereby the first and second ballistic-resistant panels are releasably engaged in fixed adjacent relation to provide releasably engaged ballistic-resistant panels.

Figure 17A:
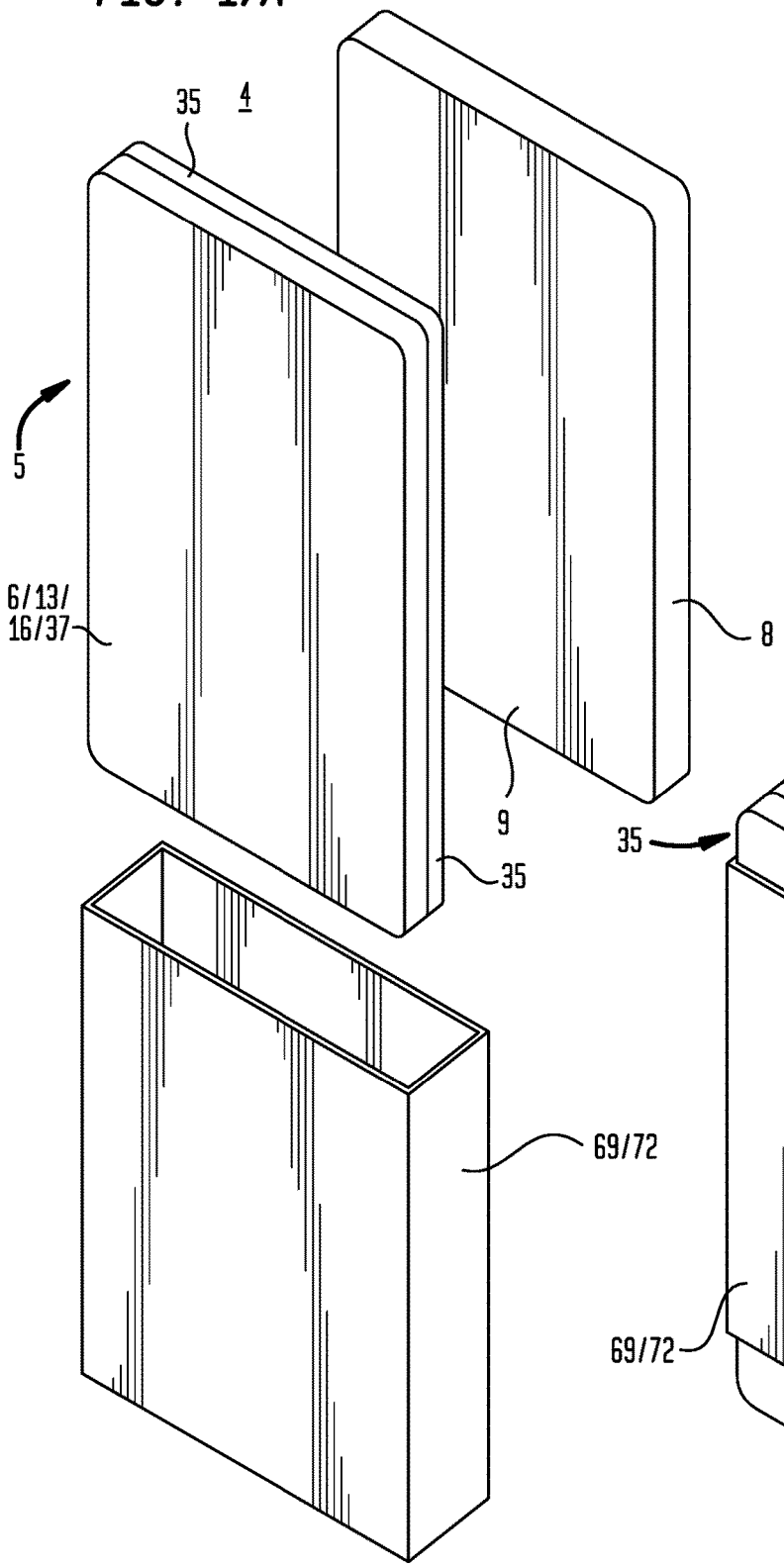

FIG. 17A is a perspective view of a particular embodiment of the releasably engagable system of ballistic-resistant panels having a securement element configured as a resiliently stretchable member, whereby first and second ballistic-resistant panels are not releasably engaged in fixed adjacent relation.

Figure 17B:
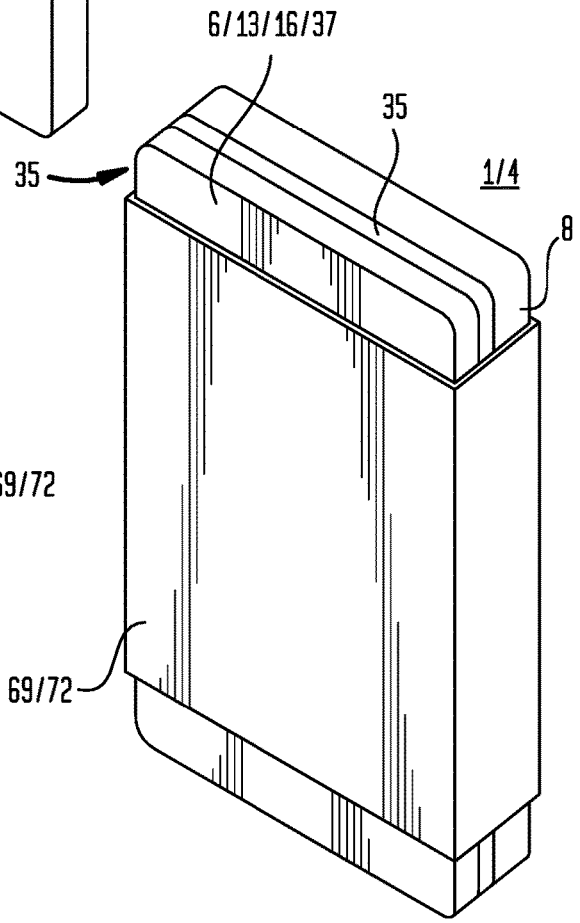

FIG. 17B is a perspective view of the first and second ballistic-resistant panels shown in FIG. 17A, but whereby the first and second ballistic-resistant panels are releasably engaged in fixed adjacent relation to provide releasably engaged ballistic-resistant panels.

III. DETAILED DESCRIPTION OF THE INVENTION

Figure 1:
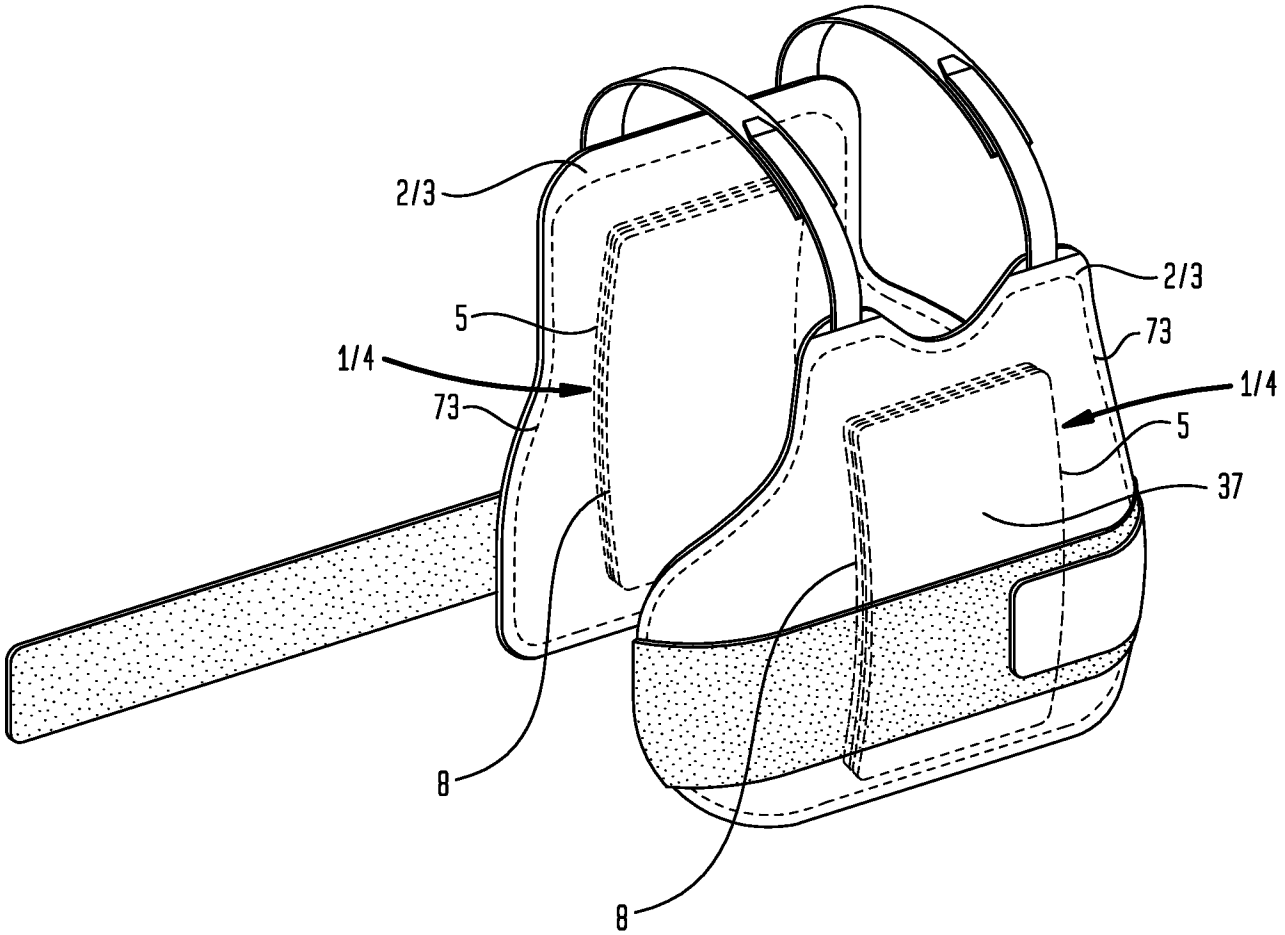
FIG. 1 is an illustration of a method of using a particular embodiment of the releasably engagable system of ballistic-resistant panels, whereby releasably engaged ballistic-resistant panels are disposed in a garment to provide a ballistic-resistant garment which may be worn to protect a user from a ballistic threat.

Now referring primarily to FIG. 1, which illustrates a method of using a particular embodiment of releasably engaged ballistic-resistant panels (1) for disposition within a garment (2) to provide a ballistic-resistant garment (3) which may be worn to protect a user from one or more ballistic threats, whereby the inventive releasably engagable system of ballistic-resistant panels (4) includes a first ballistic-resistant panel (5) having opposing first ballistic-resistant panel front and back surfaces (6)(7) and a second ballistic-resistant panel (8) having opposing second ballistic-resistant panel front and back surfaces (9)(10).

Further, the releasably engagable system of ballistic-resistant panels (4) includes a first fastener (11) coupled to the first ballistic-resistant panel (5) and a second fastener (12) coupled to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Additionally, the releasably engagable system of ballistic-resistant panels (4) provides a modular protection system, which may offer multiple benefits relative to a permanently integrated system that cannot be separated into component parts.

As but one example, the releasably engagable system of ballistic-resistant panels (4) allows a user to modify their level of protection based upon the type of anticipated threat, whereby this modification can be accomplished with relative ease by releasably engaging or disengaging the ballistic-resistant panels (5)(8). As weight and thickness can be significantly related to the perceived comfort of body armor, the releasably engagable system of ballistic-resistant panels (4) facilitates minimization of these two parameters while providing the desired level of protection. Said another way, the releasably engagable system of ballistic-resistant panels (4) allows a user to wear only the amount of body armor necessary, thus avoiding having to wear extraneous body armor and consequently, unnecessary weight and volume.

Moreover, due to the modularity of the releasably engagable system of ballistic-resistant panels (4), upon damage to one of the ballistic-resistant panels (5)(8), a user can relatively easily replace only the damaged ballistic-resistant panel (5)(8) instead of having to replace the entire system, as is required for permanently integrated systems.

The term "panel" for the purposes of this invention means any three-dimensionally shaped object, whether flat (planar) or contoured (arcuate), which can have any applicable perimeter shape, whether regular or irregular.

The term "fixed" for the purposes of this invention means attached in a way that generally precludes movement.

The term "adjacent" for the purposes of this invention means close to, near, next to, or the like, whereby there may or may not be contact between adjacent elements, depending upon the application.

Ballistic Resistance Standards

As stated above, the releasably engagable system of ballistic-resistant panels (4) includes a first ballistic-resistant panel (5) having opposing first ballistic-resistant panel front and back surfaces (6)(7) and a second ballistic-resistant panel (8) having opposing second ballistic-resistant panel front and back surfaces (9)(10), whereby the ballistic-resistant panels (5)(8) are capable of slowing or stopping one or more threats, such as a high velocity projectile or ballistic threat, for example via one or more energy-absorbing mechanisms.

The ballistic-resistant panels (5)(8) described herein can comply with certain performance standards, such as the minimum performance standards for law enforcement equipment, including minimum performance standards for police body armor, set forth by the United States National Institute of Justice (NIJ). For example, the ballistic-resistant panels (5)(8) described herein can comply with NIJ Standard-0101.06, "Ballistic Resistance of Body Armor" (July 2008), which is hereby incorporated by reference herein in its entirety.

Under NIJ Standard-0101.06, personal body armor is classified into five types (IIA, II, IIIA, III, and IV) by level of ballistic performance.

As to particular embodiments, one or more of the instant ballistic-resistant panels (5)(8) can be classified as Type IIA armor, whereby Type HA armor that is new and unworn is tested with 9 mm Full Metal Jacketed Round Nose (FMJ RN) bullets with a specified mass of 8.0 g (124 gr) and a velocity of 373 m/s±9.1 m/s (1225 ft/s±30 ft/s) and with .40 S&W Full Metal Jacketed (FMJ) bullets with a specified mass of 11.7 g (180 gr) and a velocity of 352 m/s±9.1 m/s (1155 ft/s±30 ft/s). Type IIA armor that has been conditioned is tested with 9 mm FMJ RN bullets with a specified mass of 8.0 g (124 gr) and a velocity of 355 m/s±9.1 m/s (1165 ft/s±30 ft/s) and with .40 S&W FMJ bullets with a specified mass of 11.7 g (180 gr) and a velocity of 325 m/s±9.1 m/s (1065 ft/s±30 ft/s).

As to particular embodiments, one or more of the instant ballistic-resistant panels (5)(8) can be classified as Type II armor, whereby Type II armor that is new and unworn is tested with 9 mm FMJ RN bullets with a specified mass of 8.0 g (124 gr) and a velocity of 398 m/s±9.1 m/s (1305 ft/s±30 ft/s) and with .357 Magnum Jacketed Soft Point (JSP) bullets with a specified mass of 10.2 g (158 gr) and a velocity of 436 m/s±9.1 m/s (1430 ft/s±30 ft/s). Type II armor that has been conditioned is tested with 9 mm FMJ RN bullets with a specified mass of 8.0 g (124 gr) and a velocity of 379 m/s±9.1 m/s (1245 ft/s±30 ft/s) and with .357 Magnum JSP bullets with a specified mass of 10.2 g (158 gr) and a velocity of 408 m/s±9.1 m/s (1340 ft/s±30 ft/s).

As to particular embodiments, one or more of the instant ballistic-resistant panels (5)(8) can be classified as Type IIIA armor, whereby Type IIIA armor that is new and unworn is tested with .357 SIG FMJ Flat Nose (FN) bullets with a specified mass of 8.1 g (125 gr) and a velocity of 448 m/s±9.1 m/s (1470 ft/s±30 ft/s) and with .44 Magnum Semi Jacketed Hollow Point (SJHP) bullets with a specified mass of 15.6 g (240 gr) and a velocity of 436 m/s±9.1 m/s (1430 ft/s±30 ft/s). Type IIIA armor that has been conditioned shall be tested with .357 SIG FMJ FN bullets with a specified mass of 8.1 g (125 gr) and a velocity of 430 m/s±9.1 m/s (1410 ft/s±30 ft/s) and with .44 Magnum SJHP bullets with a specified mass of 15.6 g (240 gr) and a velocity of 408 m/s±9.1 m/s (1340 ft/s±30 ft/s).

As to particular embodiments, one or more of the instant ballistic-resistant panels (5)(8) can be classified as Type III armor, whereby Type III hard armor or plate inserts are tested in a conditioned state with 7.62 mm FMJ, steel jacketed bullets (U.S. Military designation M80) with a specified mass of 9.6 g (147 gr) and a velocity of 847 m/s±9.1 m/s (2780 ft/s±30 ft/s). Type III flexible armor is tested in both the "as new" state and the conditioned state with 7.62 mm FMJ, steel jacketed bullets (U.S. Military designation M80) with a specified mass of 9.6 g (147 gr) and a velocity of 847 m/s±9.1 m/s (2780 ft/s±30 ft/s).

For a Type III hard armor or plate insert that is tested as an in conjunction design, the flexible armor is tested in accordance with this standard and found compliant as a stand-alone armor at its specified threat level. The combination of the flexible armor and hard armor/plate is then tested as a system and found to provide protection at the system's specified threat level.

As to particular embodiments, one or more of the instant ballistic-resistant panels (5)(8) can be classified as Type IV armor, whereby Type IV hard armor or plate inserts are tested in a conditioned state with .30 caliber armor piercing (AP) bullets (U.S. Military designation M2 AP) with a specified mass of 10.8 g (166 gr) and a velocity of 878 m/s±9.1 m/s (2880 ft/s±30 ft/s). Type IV flexible armor is tested in both the "as new" state and the conditioned state with .30 caliber AP bullets (U.S. Military designation M2 AP) with a specified mass of 10.8 g (166 gr) and a velocity of 878 m/s±9.1 m/s (2880 ft/s±30 ft/s).

For a Type IV hard armor or plate insert that is tested as an in conjunction design, the flexible armor is tested in accordance with this standard and found compliant as a stand-alone armor at its specified threat level. The combination of the flexible armor and hard armor/plate is then tested as a system and found to provide protection at the system's specified threat level.

First Ballistic-Resistant Panel

Now referring primarily to FIG. 2A through FIG. 5C, the first ballistic-resistant panel (5) can incorporate a steel plate (not shown) or a ceramic plate system (13) including a ceramic plate (14) encased in a containment layer (15), whereby the containment layer (15) can serve as a protective covering, casing, shell, or the like, surrounding the ceramic plate (14).

Regarding the ceramic plate system (13), the ceramic plate (14) can function as a disruptor, which can serve to deform and/or fragment a projectile. Thus, the ceramic plate (14) should be harder than the projectile and for example, should be harder than the steel used in an armor piercing (AP) round.

Correspondingly, the ceramic plate (14) can be formed from, for example, silicon carbide, boron carbide, titanium carbide, tungsten carbide, zirconia toughened alumina, high-density aluminum oxide, or the like, or combinations thereof. As but one illustrative example, a silicon carbide (SiC) plate which may be useful with the instant invention is CERASHIELD™ Silicon Carbides Armor Ceramics, obtainable from CoorsTek, Inc. in Golden, Colorado, USA. As but a second illustrative example, a boron carbide ($B_4C$) plate which may be useful with the instant invention is CERASHIELD™ Boron Carbides Armor Ceramics, also obtainable from CoorsTek, Inc. in Golden, Colorado, USA.

Concerning conventional ceramic plates employed as hard body armor inserts, typically, when a projectile is fired, the ceramic plate may stop the projectile but in doing so, may fracture or crack into a plurality of fragments. Following, the fragments may acquire momentum from the projectile, consequently becoming projectiles themselves which can potentially harm the user of the ceramic plate. Additionally, after the ceramic plate has been struck by a single projectile, the damage incurred by the ceramic plate may be significant enough to preclude the ceramic plate from sufficiently protecting the user from additional projectiles. Thus, the ceramic plate may need to be replaced, often at a substantial cost.

Due to the brittle nature of conventional ceramic plates employed as hard body armor inserts, a user should be extremely careful not to damage the ceramic plate during customary handling or wear. For example, during handling, if the ceramic plate inadvertently contacts a hard surface, such as when a user accidentally drops the ceramic plate on the ground, the ceramic plate can fracture, subsequently requiring replacement. As an example during wear, if the ceramic plate contacts a hard surface, such as when a user rolls on the ground during a maneuver, the ceramic plate can fracture, therefore requiring replacement.

Thus, despite their prevalence, conventional ceramic plates employed as hard body armor inserts may not be particularly well-suited for combat or training situations, in which equipment may be susceptible to suboptimal treatment due to the challenging circumstances.

Accordingly, to prevent a ceramic plate (14) employed as a hard body armor insert from fracturing, cracking, or fragmenting during handling, wear, or when struck by a projectile, it is herein disclosed that the ceramic plate (14) can be encased in a containment layer (15) to provide an encased ceramic plate (16) which may have enhanced ballistic-resistant performance relative to a ceramic plate (14) which is not encased in a containment layer (15).

Correspondingly, the encased ceramic plate (16) may be significantly safer than conventional ceramic plates for use proximate a body, for example a human body, because, to restate, the containment layer (15) which encases the ceramic plate (14) precludes, whether partially or entirely, the ceramic plate (14) from fracturing, cracking, or fragmenting during handling, wear, or when struck by a projectile.

Figure 5B:
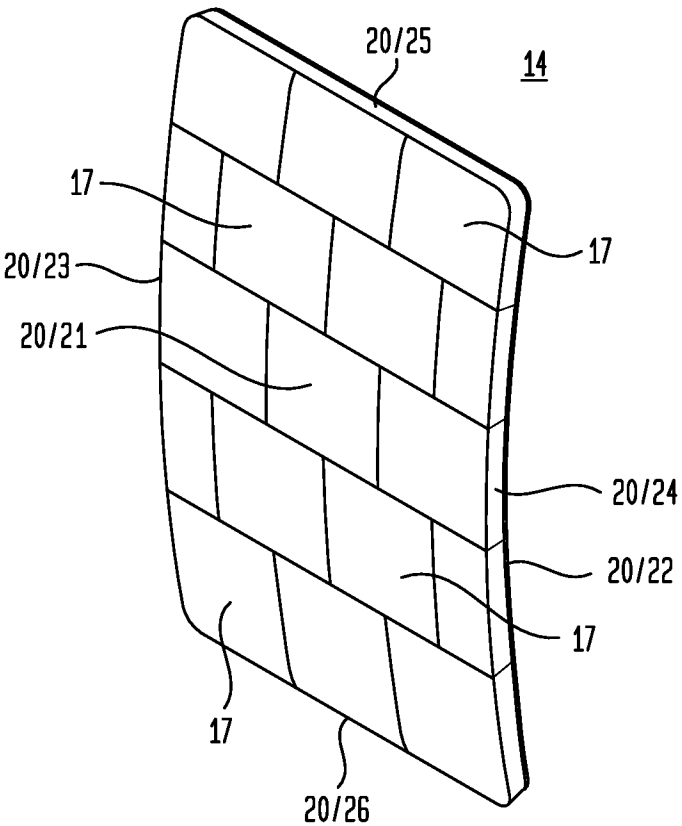
FIG. 5B is a perspective view of a particular embodiment of a ceramic plate of a first ballistic-resistant panel of the releasably engagable system of ballistic-resistant panels, whereby the ceramic plate is formed from a plurality of discrete ceramic tiles.
Figure 5A:
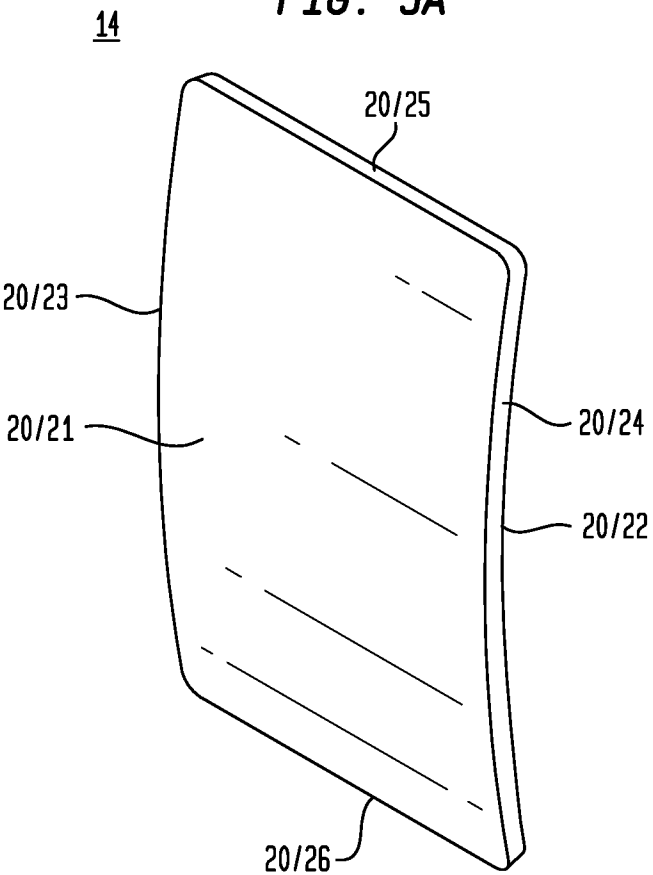
FIG. 5A is a perspective view of a particular embodiment of a ceramic plate of a first ballistic-resistant panel of the releasably engagable system of ballistic-resistant panels, whereby the ceramic plate is formed from one monolithic tile.
Figure 5C:
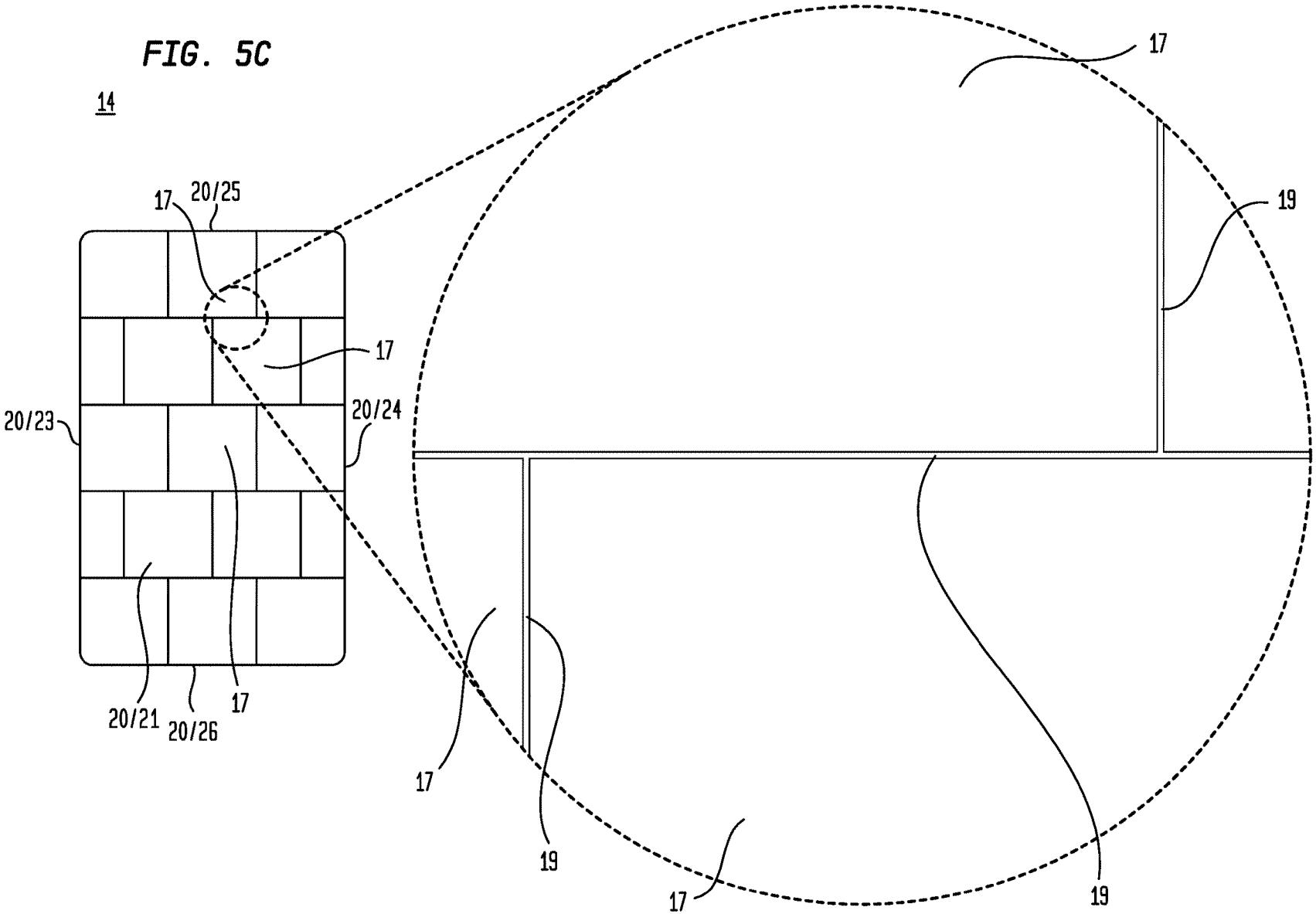
FIG. 5C is an enlarged view of the ceramic tiles shown in FIG. 5B.

The ceramic plate (14), which can be encased in a containment layer (15) in accordance with the instant invention, can be (i) a one-piece construct or a monolithic tile (as shown in FIG. 5A), or (ii) a multi-piece construct assembled from a plurality of discrete ceramic tiles (17) (as shown in FIG. 5B and FIG. 5C).

Regarding the latter, the ceramic tiles (17) which form the ceramic plate (14) can be arranged as an array of polygonal shapes, such as triangles, squares, rectangles, pentagons, hexagons, etc., or as an array of non-polygonal shapes. As to particular embodiments, the ceramic tiles (17) can be arranged on an adhesive layer (18) such as adhesive film, in spaced apart relation to provide a gap (19) between adjacent ceramic tiles (17), whereby the gap (19) can be sufficiently wide to preclude energy transfer between adjacent ceramic tiles (17) while being sufficiently narrow to prevent the passage of a projectile or ballistic threat therethrough. As but one illustrative example, the gap (19) between adjacent ceramic tiles (17) can be about 0.005 inches to about 0.015 inches.

Now referring primarily to FIG. 3I, and FIG. 5A through FIG. 5C, the ceramic plate (14) can be defined by a ceramic plate outer surface (20) which includes opposing front and back faces (21)(22), opposing side edges (23)(24), and opposing end edges (25)(26). Following, the containment layer (15) can overlay the ceramic plate outer surface (20), whereby the containment layer (15) can encase or encapsulate the ceramic plate (14) and moreover, whereby the containment layer (15) can apply a compressive force to the ceramic plate (14).

As to particular embodiments, the containment layer (15) can be (i) adjacent to the ceramic plate outer surface (20), (ii)

directly adjacent to the ceramic plate outer surface (20), and/or (iii) in contact with the ceramic plate outer surface (20), depending upon the application.

As to particular embodiments, the containment layer (15) can (i) surround the ceramic plate outer surface (20) or (ii) entirely surround the ceramic plate outer surface (20), thereby entirely encasing the ceramic plate (14). Said another way, the containment layer (15) can cover all outer surfaces of the ceramic plate (14).

The containment layer (15) can include a fabric sheet (27) combined with a resin, whereby as to particular embodiments, the fabric sheet (27) can be a ballistic-resistant fabric sheet (27) made from a plurality of fibers, whether natural or synthetic, arranged into a woven or nonwoven structure which is typically, but not necessarily, a relatively thin structure.

As to particular embodiments, the fabric sheet (27) can be formed from aramid fibers, carbon fibers, carbon nanotubes, glass fibers, or any other suitable fibers that may be considered high-performance fibers to one skilled in the art of ballistics. For example, aramid fiber fabric sheets (27), such as woven aramid prepregs, and carbon fiber fabric sheets (27), such as woven carbon prepregs, which may be useful with the instant invention can be obtained from Axiom Materials, Inc. in Santa Ana, California, USA. As an additional example, aramid fiber fabric sheets (27), such as those made from DUPONT™ KEVLAR® aramid fibers, can be obtained from DuPont.

As to particular embodiments, the fabric sheet (27) can be a hybrid of two or more types of high-performance fibers, such as a hybrid fabric sheet (27) made of aramid fibers and carbon fibers.

The resin, whether natural or synthetic, which is combined with the fabric sheet (27) can be a thermosetting resin, such as a polyester resin, a vinyl-ester resin, or an epoxy resin, whereby the resin can be selected based on properties of the fabric sheet (27) and the desired attributes of the ceramic plate system (13).

The fabric sheet (27) can be coated, covered, laminated, or impregnated with the resin, depending upon the embodiment. Regarding the latter, the fabric sheet (27) can be pre-impregnated with the resin (thus provided as a pre-impregnated fabric sheet, which may be commonly referred to as a "prepreg" fabric sheet) and maintained at a relatively cool or cold temperature to prevent the resin from curing prematurely.

Once desired, the resin can be cured (polymerized) by the application of heat, pressure, or both (via, for example, an oven or autoclave), depending upon the characteristics of the specific resin and specific fabric sheet (27) selected for combination.

The fabric sheet (27) can be coupled to the ceramic plate (14) in overlaying engagement by any suitable process, such as a layout process during which the ceramic plate outer surface (20) can be engaged with a fabric sheet inner surface (28) of the fabric sheet (27). Subsequently, the fabric sheet (27) can be wrapped or swathed about the ceramic plate (14) to surround the ceramic plate outer surface (20) and encase the ceramic plate (14).

As to particular embodiments which do not utilize prepreg fabric sheets (27), following wrapping or swathing, the resin can be applied to a fabric sheet outer surface (29) of the fabric sheet (27) to coat or cover the fabric sheet outer surface (29). Upon subsequent processing, the resin will be coerced into the fabric sheet (27) to sufficiently wet out the fabric sheet (27) with the resin, and cure.

As to particular embodiments which utilize prepreg fabric sheets (27), following wrapping or swathing, the step in which the resin is applied to the fabric sheet outer surface (29) can be omitted, as the prepreg fabric sheet (27) inherently contains a sufficient amount of resin which, upon subsequent processing, can cure.

Figure 3B:
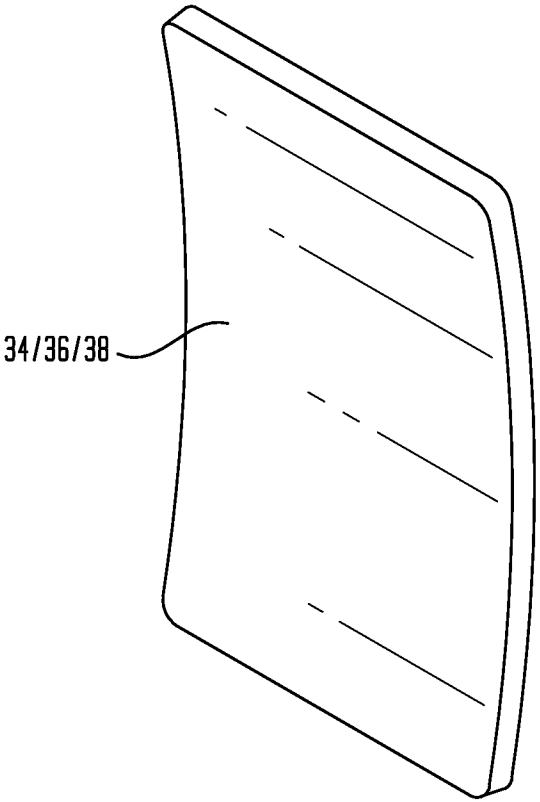
FIG. 3B is a perspective view of a back of the particular embodiment of the first ballistic-resistant panel shown in FIG. 3A.
Figure 3A:
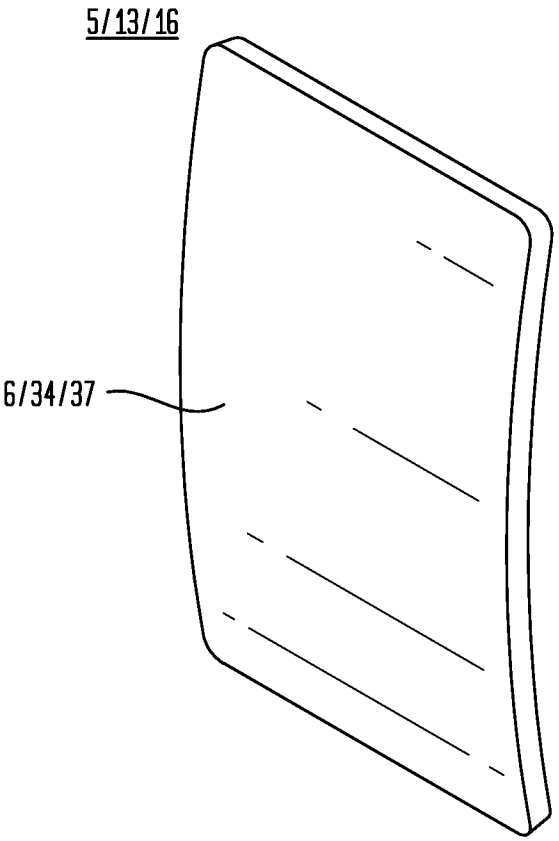
FIG. 3A is a perspective view of a front of a particular embodiment of a first ballistic-resistant panel of the releasably engagable system of ballistic-resistant panels, whereby the first ballistic-resistant panel includes a ceramic plate system.
Figures 3C, 3D, 3E, 3F, 3G, 3H, 3I:
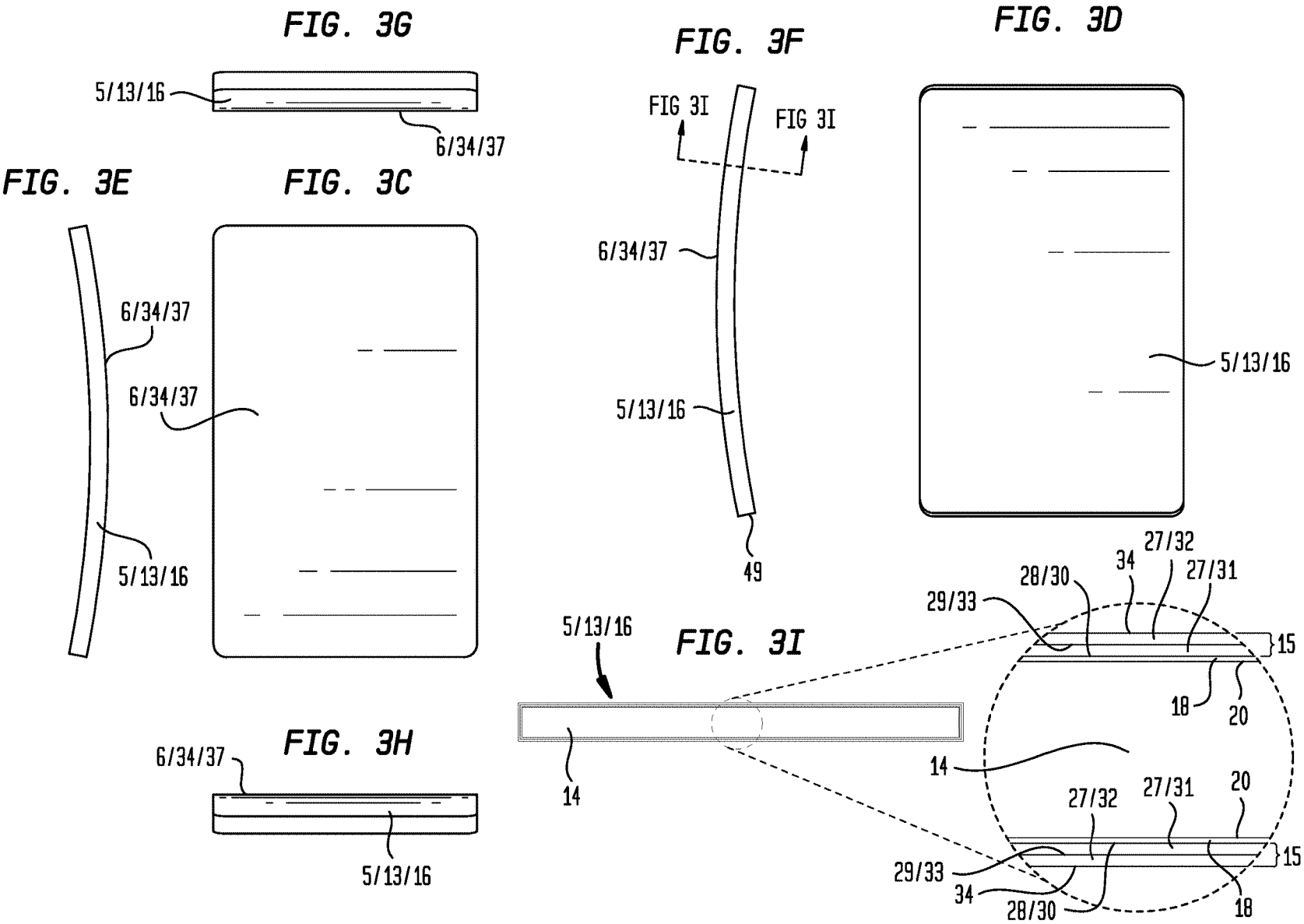
FIG. 3C is a front view of the particular embodiment of the first ballistic-resistant panel shown in FIG. 3A.
FIG. 3D is a rear view of the particular embodiment of the first ballistic-resistant panel shown in FIG. 3A.
FIG. 3E is a left side view of the particular embodiment of the first ballistic-resistant panel shown in FIG. 3A.
FIG. 3F is a right side view of the particular embodiment of the first ballistic-resistant panel shown in FIG. 3A.
FIG. 3G is a top view of the particular embodiment of the first ballistic-resistant panel shown in FIG. 3A.
FIG. 3H is a bottom view of the particular embodiment of the first ballistic-resistant panel shown in FIG. 3A.
FIG. 3I is a cross-sectional view of the particular embodiment of the first ballistic-resistant panel shown in FIG. 3F, whereby the ceramic plate system includes a ceramic plate surrounded by an adhesive layer surrounded by a first fabric sheet surrounded by a second fabric sheet.

Now referring primarily to FIG. 3I, to facilitate adhesion of the containment layer (15) to the ceramic plate (14) and particularly, of a containment layer inner surface (30) to the ceramic plate outer surface (20), an adhesive layer (18) can be disposed between the ceramic plate outer surface (20) and the containment layer inner surface (30) (thus, the adhesive layer (18) can be in contact with the ceramic plate outer surface (20) and the containment layer inner surface (30)), whereby the adhesive layer (18) can include an adhesive film which can be the same adhesive film described above on which the ceramic tiles (17) comprising the ceramic plate (14) are arranged. For example, a thermoplastic adhesive film based on modified polyolefines which may be useful with the instant invention is nolax A21.2007, obtainable from nolax Inc. in Tucker, Georgia, USA. As an additional example, an epoxy adhesive film which may be useful with the instant invention is L-F610, obtainable from L&L Products, Inc in West Columbia, South Carolina, USA.

As to particular embodiments, the adhesive layer (18) can provide a bond upon the application of heat, pressure, or both (via, for example, an oven or autoclave), depending upon the characteristics of the specific adhesive layer (18) selected. After cooling, the adhesive layer (18) can effectively bond the containment layer (15) to the ceramic plate (14) such that the containment layer (15) and the ceramic plate (14) are attached or joined in a manner that components so arranged cannot be detached or separated from each other without damaging the components and/or degrading the functionality of the components.

Notably, experimental testing has revealed that the ceramic plate system (13) including a containment layer (15) bonded to the ceramic plate (14) via an adhesive layer (18), as described above, exhibits unexpectedly superior ballistic-resistant performance than would be anticipated from the sum of the ballistic-resistant performance of each of its components.

As to particular embodiments, the containment layer (15) can serve to enhance the ballistic-resistant performance of the ceramic plate system (13) by creating a sealed volume around the ceramic plate (14). Accordingly, when a projectile breaches the containment layer (15) and begins to enter the sealed volume created around the ceramic plate (14), opposing forces can be exerted against the projectile because the sealed volume is bounded by the cured and hardened containment layer (15) which has a high tensile strength; thus, the sealed volume resists any significant expansion in volume upon a breach.

Following, as the projectile breaches the sealed volume and forces mass into the sealed volume (the mass being, for example, the projectile itself and associated hot gases), opposing forces resist the mass being driven into the sealed volume, as the sealed volume is precluded from expanding to accommodate the mass entering the sealed volume. Notably, evidence of the opposing forces has been observed during experimental testing, for example via observation of the expulsion of projectile fragments and hot gases from the point of breach in a direction opposite of the projectile's original flight path. Additionally, evidence of the opposing forces has been observed to produce mushrooming of the projectile.

Again referring primarily to FIG. 3I, as to particular embodiments, the containment layer (15) can include a plurality fabric sheets (27), such as a first fabric sheet (31) and a second fabric sheet (32) (and as to particular embodiments, a third fabric sheet (not shown), and so on and so forth). Consequently, the ceramic plate (14) can be encased or encapsulated by a plurality of fabric sheets (27).

As but one illustrative example, the ceramic plate system (13) can include an aramid fiber first fabric sheet (31) (such as a prepreg aramid fiber fabric sheet) bonded to a ceramic plate (14) via an adhesive layer (18) disposed between the ceramic plate outer surface (20) and the containment layer inner surface (30). Additionally, the ceramic plate system (13) can further include a carbon fiber second fabric sheet (32) coupled to the aramid fiber first fabric sheet (31) in overlaying engagement such that the carbon fiber second fabric sheet (32) can be wrapped or swathed about the aramid fiber first fabric sheet (31) to contact and surround an aramid fiber first fabric sheet outer surface (33) and encase the aramid fiber first fabric sheet (31), the adhesive layer (18), and the ceramic plate (14).

As to particular embodiments of the ceramic plate system (13) incorporating a containment layer (15) including a plurality of fabric sheets (27), the adhesive layer (18) and the first fabric sheet (31) can be disposed about the ceramic plate (14) to provide a singly-wrapped ceramic plate and following, the singly-wrapped ceramic plate can be processed to bond the first fabric sheet (31) to the ceramic plate (14) and to cure the resin associated with the first fabric sheet (31), thus providing a processed singly-wrapped ceramic plate. Subsequently, a second fabric sheet (32) can be disposed about the processed singly-wrapped ceramic plate to provide a doubly-wrapped ceramic plate, which can then be processed to cure the resin associated with the second fabric sheet (32), thus providing a processed doubly-wrapped ceramic plate. As to particular embodiments, additional fabric sheets (27) can be added in a similar fashion, whereby processing occurs after each wrapping.

As to other particular embodiments of the ceramic plate system (13) incorporating a containment layer (15) including a plurality of fabric sheets (27), the adhesive layer (18) and the first fabric sheet (31) can be disposed about the ceramic plate (14) to provide a singly-wrapped ceramic plate. Following, a second fabric sheet (32) can be disposed about the singly-wrapped ceramic plate to provide a doubly-wrapped ceramic plate. Subsequently, the doubly-wrapped ceramic plate can be processed to bond the first fabric sheet (31) to the ceramic plate (14), to cure the resin associated with the first fabric sheet (31), and to cure the resin associated with the second fabric sheet (32) (which may or may not bond the second fabric sheet (32) to the first fabric sheet (31), depending upon the application), thus providing a processed doubly-wrapped ceramic plate. As to particular embodiments, additional fabric sheets (27) can be added in a similar fashion, whereby processing occurs after the wrapping of the outermost fabric sheet (27).

Manufacturing Processes—Vacuum Bagging

During the manufacturing process, the ceramic plate system (13) can be disposed/sealed within a vacuum bag and subjected to heat, pressure, or both, whereby processing results in (i) bonding of the containment layer (15) to the ceramic plate (14), and (ii) curing of the resin combined with the fabric sheet(s) (27) to provide a bonded and cured ceramic plate system (13).

The vacuum bagging process can remove air present between the containment layer (15) and the ceramic plate (14) prior to curing of the containment layer (15), thus decreasing the thickness of the ceramic plate system (13). Additionally, the vacuum bagging process can also improve the surface finish of the containment layer (15) and improve the overall ballistic-resistant performance of the ceramic plate system (13).

During the vacuum bagging process, the ceramic plate (14) can be wrapped or swathed with one or more fabric sheets (27) which provide the containment layer (15), and then inserted into a vacuum bag. As detailed above, the fabric sheet(s) (27) can be pre-impregnated with the resin or the resin can be applied to the fabric sheet(s) (27) via a wet layup process. Alternatively, the resin can be introduced during the vacuum bagging process through an infusion process.

The vacuum bag can be formed from any suitable material, such as LEXAN™, silicone rubber, TEFLON™, fiberglass-reinforced polyurethane, fiberglass-reinforced polyester, or KEVLAR®-reinforced rubber. As to particular embodiments, the vacuum bag can be made from a transparent polymer material, such Nylon Bagging Film, obtainable from U.S. Composites, Inc. in West Palm Beach, Florida, USA.

As to particular embodiments, it may be beneficial to use a peel ply layer or release layer between the ceramic plate system (13) and the vacuum bag, specifically between a containment layer outer surface (34) of the containment layer (15) and a vacuum bag inner surface of the vacuum bag, to prevent the containment layer (15) from adhering to the vacuum bag as the resin cures during processing. Using a peel ply layer or release layer, although not mandatory, may result in a more desirable surface finish on the containment layer (15) and may also protect the vacuum bag from being damaged when removing the bonded and cured ceramic plate system (13) from the vacuum bag, thus allowing the vacuum bag to be reused.

For processing, a vacuum hose extending from a vacuum pump can be connected to a vacuum port located in the vacuum bag. Subsequently, the vacuum pump can be operated to evacuate air from the sealed volume located between the vacuum bag inner surface and the ceramic plate system (13) located within the vacuum bag.

As to particular embodiments, a breather layer can be disposed between the vacuum bag inner surface and the ceramic plate system (13) to improve the evacuation of air from the sealed volume, whereby the breather layer can be formed from an air-permeable material which provides a pathway to encourage the evacuation of air from the interior of the sealed volume.

As air is evacuated from the sealed volume, the air pressure inside the vacuum bag decreases while the ambient air pressure acting on a vacuum bag outer surface of the vacuum bag remains at atmospheric pressure. The resultant pressure differential created between the inside and outside of the vacuum bag can be sufficient to produce compressive forces which act on the ceramic plate system (13) disposed/sealed within the vacuum bag. These compressive forces are applied uniformly to the ceramic plate system (13), thus producing a ceramic plate system (13) with uniform or nearly uniform thickness. Additionally, the compressive forces can decrease the thickness of the ceramic plate system (13) such that the thickness of the bonded and cured ceramic plate system (13) can be substantially less than the thickness of the ceramic plate system (13) prior to processing, which may be advantageous for applications requiring relatively thin ceramic plate systems (13).

Manufacturing Processes—Heat Application

As noted above, during the manufacturing process, the ceramic plate system (13) can be subjected to heat, whereby the application of heat can promote curing and hardening of the resin combined with the fabric sheet(s) (27) which provide the containment layer (15). Further, the application of heat can promote bonding of the containment layer (15) to the ceramic plate (14), particularly when an adhesive layer (18) is disposed between the ceramic plate outer surface (20) and the containment layer inner surface (30). As to particular embodiments, subjecting the ceramic plate system (13) to heat can significantly reduce manufacturing time, as curing of the resin can be substantially accelerated by the application of heat.

To apply heat to the ceramic plate system (13), suitable heating equipment, such as a conventional oven, an infrared oven, a hydroclave, an autoclave, or the like, may be used, all of which can include a heating chamber. To ensure accurate temperature control throughout the heating process, the heating equipment can include a control loop feedback controller, such as a proportional-integral-derivative (PID) controller. To avoid temperature variations within the heating chamber, a fan can be installed and operated within the heating chamber to effectively circulate the air and provide a generally consistent air temperature about the ceramic plate system (13) for generally consistent curing of the resin.

During the heating process, a process temperature and a process time can be selected based, at least in part, on the properties of the resin, the properties of the fabric sheet(s) (27), or a combination thereof.

The process temperature, for example, can be in a range of between about 125-550 degrees Fahrenheit. As to particular embodiments, the process temperature can be selected from the group including or consisting of a range: between about 140-225 degrees Fahrenheit; between about 225-250 degrees Fahrenheit; between about 225-275 degrees Fahrenheit; between about 225-350 degrees Fahrenheit; between about 240-290 degrees Fahrenheit; between about 240-260 degrees Fahrenheit; between about 250-300 degrees Fahrenheit; and between about 250-350 degrees Fahrenheit.

The process time, for example, can be selected from the group including or consisting of: at least 1 second; at least 5 minutes; at least 15 minutes; at least 30 minutes; at least 60 minutes; at least 90 minutes; at least 120 minutes; at least 180 minutes; at least 240 minutes; and at least 480 minutes.

As but one illustrative example, a process temperature and a process time which may be useful with the instant invention can be about 240-290 degrees Fahrenheit and about 45-90 minutes, respectively.

As to particular embodiments, the heating process can occur while the ceramic plate system (13) is disposed/sealed within the vacuum bag. As to other particular embodiments, the ceramic plate system (13) can undergo heating after the vacuum bagging process is complete and the ceramic plate system (13) has been removed from the vacuum bag. As to yet other particular embodiments, the ceramic plate system (13) can be heated before being subjected to the vacuum bagging process. Concerning the latter, the heating process time may be relatively short to avoid completely curing the resin, whereby the aim of the relatively short heating process prior to vacuum bagging may be to initiate the curing process prior to the vacuum bagging process to reduce the requisite residence time of the ceramic plate system (13) within the vacuum bag. Once pre-heated, inserted, and disposed/sealed within the vacuum bag, the resin can then be cured to completion.

Manufacturing Processes—Pressure Application

As noted above, during the manufacturing process, the ceramic plate system (13) can be subjected to pressure, whereby the application of pressure can improve the ballistic-resistant performance of the ceramic plate system (13). Moreover, the application of pressure can decrease the thickness of the ceramic plate system (13), for example by precluding the formation of gas or air pockets between the ceramic plate (14) and the containment layer (15) as the resin off-gases during curing.

To apply pressure to the ceramic plate system (13), suitable equipment for the pressurizing process, such as a mechanical press, a bladder press, a hydroclave, an autoclave, or the like, can be used. As to particular embodiments, the heating chamber for the heat application process may be located within, or can be the same apparatus as, the equipment for the pressurizing process, whereby pressure can be applied to the ceramic plate system (13)(i) during the heating process or concurrently with the heating process, (ii) before the heating process, or (iii) after the heating process, depending upon the application.

During the pressurizing process, a process pressure and a process time can be selected based, at least in part, on the properties of the resin, the properties of the fabric sheet(s) (27), or a combination thereof.

As to particular embodiments, the process pressure can be selected from the group including or consisting of: at least about 10 psi; at least about 25 psi; at least about 50 psi; at least about 75 psi; at least about 100 psi; at least about 125 psi; a range between about 10-125 psi; a range between about 10-100 psi; a range between about 10-75 psi; a range between about 10-50 psi; a range between about 10-25 psi; a range between about 25-125 psi; a range between about 50-125 psi; a range between about 75-125 psi; and a range between about 100-125 psi, which may be achievable with equipment such as a manual press or a small autoclave, whereby the process pressure.

The process time, for example, can be selected from the group including or consisting of: at least 1 second; at least 5 minutes; at least 15 minutes; at least 30 minutes; at least 60 minutes; at least 90 minutes; at least 120 minutes; at least 180 minutes; at least 240 minutes; and at least 480 minutes.

As but one illustrative example, a process pressure and a process time which may be useful with the instant invention can be about less than 125 psi and about 45-90 minutes, respectively.

As but a second illustrative example, a process pressure and a process time which may be useful with the instant invention can be a range between about 60-100 psi and about 45-90 minutes, respectively.

As to particular embodiments, the pressurizing process can occur while the ceramic plate system (13) is disposed/sealed within the vacuum bag and subjected to the vacuum bagging process and while the apparatus is maintained at a process temperature to promote curing of the resin. Alternatively, pressure can be applied to the ceramic plate system (13) before the ceramic plate system (13) is disposed/sealed within the vacuum bag or after the ceramic plate system (13) is removed from the vacuum bag, depending upon the application. Regardless of the sequence, pressure should preferably be applied to the ceramic plate system (13) before curing of the resin advances to a point such that the resin begins to harden.

As a result of the application of pressure to the containment layer outer surface (34) while the resin cures during processing, the containment layer (15) can harden about the ceramic plate (14) to tightly encase or encapsulate the ceramic plate (14), thereby constricting the ceramic plate (14). Correspondingly, after processing, the resultant hardened containment layer (15) can continually apply compressive forces to the ceramic plate outer surface (20).

Notably, experimental testing has revealed that compressive forces continually applied to the ceramic plate outer surface (20) can act to preclude or minimize fracturing, cracking, or fragmenting of the ceramic plate (14), particularly after the ceramic plate (14) has been struck by a projectile, by effectively dampening the shock waves associated with the ceramic plate (14). For example, the compressive forces ensure that the containment layer (15) is in close contact with the ceramic plate outer surface (20), thereby enabling the containment layer (15) to effectively absorb and dissipate shock wave energy associated with the ceramic plate (14) immediately after impact.

Cover or Coating

As to particular embodiments, the ceramic plate system (13) can be encased in a cover or coating, which may be wear-resistant, water-resistant, water-proof, chemical-resistant, chemical-proof, flame-resistant, flame-retardant, or a combination thereof, whereby the cover or coating can be adapted for protecting the ceramic plate system (13) from water, chemicals (such as acids and bases), and burning. As to particular embodiments, the cover or coating can be partially or completely bonded to the ceramic plate system (13), for example by resin or an adhesive layer (18).

Backer Plate

Now referring primarily to FIG. 2A through FIG. 2H, and FIG. 4A through FIG. 4C, as to particular embodiments, the first ballistic-resistant panel (5) can include a backer plate (35) coupled to the ceramic plate system (13) and particularly, to a ceramic plate system rear surface (36) which opposes the strike face (37) of the ceramic plate system (13). More particularly, the backer plate (35) can be coupled to a containment layer rear surface (38) (or a cover or coating rear surface for embodiments including a cover or coating as described above). As but one illustrative example, for coupling to the ceramic plate system (13), a backer plate front surface (39) can be adhered to the containment layer rear surface (38) via an adhesive layer (18).

The backer plate (35) can be a rigid or substantially rigid panel formed from, for example, metal, such as steel, aluminum, or alloys thereof, or a polyethylene panel, such as a consolidated panel made from ultra-high-molecular-weight polyethylene (UHMWPE) sheets.

Following coupling of the backer plate (35) to the ceramic plate system (13) to provide a ceramic plate system-backer plate assembly (40), a fabric sheet (27), such as a carbon fiber fabric sheet (27), can be wrapped or swathed about the ceramic plate system-backer plate assembly (40) to encase the ceramic plate system-backer plate assembly (40).

Second Ballistic-Resistant Panel Now referring primarily to FIG. 2A through FIG. 2H, and FIG. 6A through FIG. 6I, the second ballistic-resistant panel (8) can function as an absorber, which can serve to absorb and/or redirect the fragments of the projectile generated upon contact of the projectile with the disruptive ceramic plate (14).

The second ballistic-resistant panel (8) can be formed from one or more ballistic-resistant fabric sheets (27) which can comprise any of a numerous and wide variety of materials, such as metal, fiberglass, composite material, polymeric material, or the like, or combinations thereof. As non-limiting examples of the latter, polymeric materials can include aramid fibers, para-aramid fibers, meta-aramid fibers, polyolefins, and thermoplastic polyethylenes, such as ultra-high-molecular-weight polyethylenes (UHMWPE).

As to particular embodiments, the ballistic-resistant fabric sheets (27) can be the same as or similar to the ballistic-resistant fabric sheets (27) described above. Correspondingly, the ballistic-resistant fabric sheets (27) can be formed from a woven or nonwoven assembly of a plurality of fibers bonded by a resin, whereby the ballistic-resistant fabric sheets (27) can be coated, covered, laminated, or impregnated with the resin, depending upon the embodiment.

To make the second ballistic-resistant panel (8), a stack of ballistic-resistant fabric sheets (27) can be heated to a temperature proximate the melting point of the resin, thereby softening the resin to promote partial or full bonding of adjacent ballistic-resistant fabric sheets (27) to provide the second ballistic-resistant panel (8). Further, as to particular embodiments, pressure can be applied to the stack of ballistic-resistant fabric sheets (27) with the softened resin to promote the partial or full bonding of adjacent ballistic-resistant fabric sheets (27) to provide the second ballistic-resistant panel (8).

Fastening System

Now referring primarily to FIG. 2A through FIG. 2H, FIG. 4A through FIG. 4C, FIG. 6A through FIG. 6H, and FIG. 7A through FIG. 14B, the releasably engagable system of ballistic-resistant panels (4) further includes a first fastener (11) coupled to the first ballistic-resistant panel (5) and a second fastener (12) coupled to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1). Additionally, the first and second fasteners (11)(12) may be useful for self-aligning the first and second ballistic-resistant panels (5)(8).

Figure 2B:
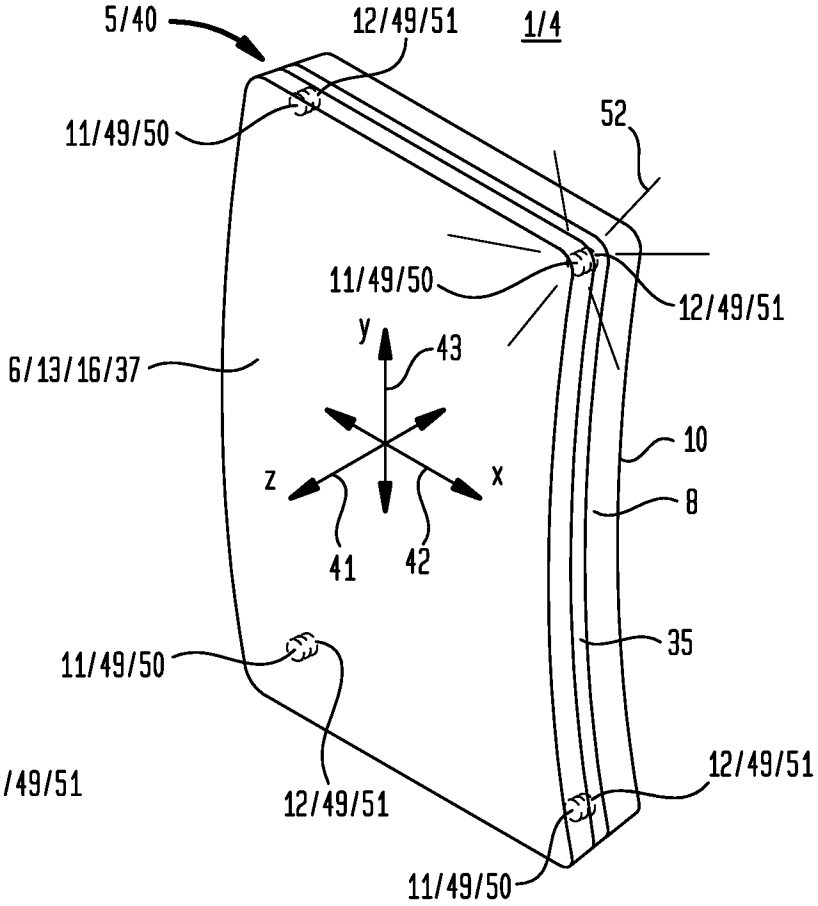
FIG. 2B is a perspective view of the first and second ballistic-resistant panels shown in FIG. 2A, but whereby the first and second ballistic-resistant panels are releasably engaged in fixed adjacent relation to provide releasably engaged ballistic-resistant panels.
Figure 2A:
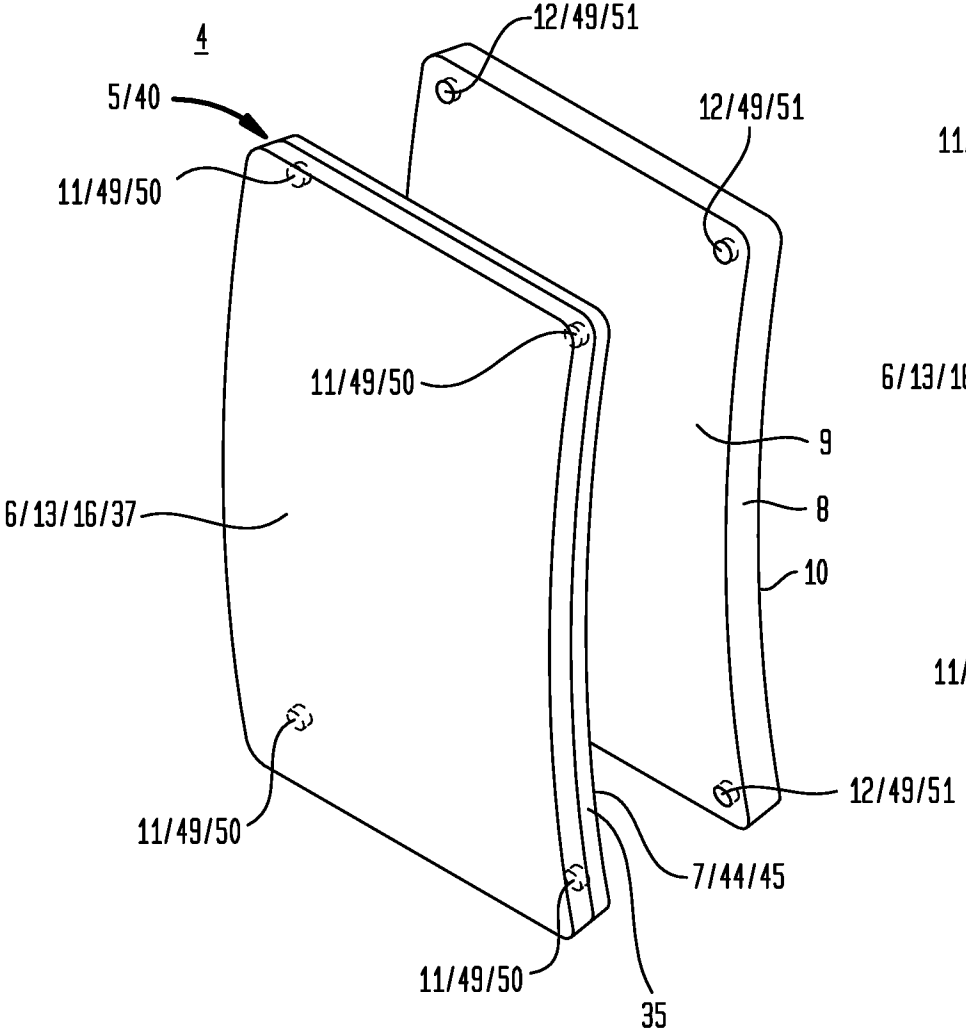
FIG. 2A is a perspective view of a particular embodiment of the releasably engagable system of ballistic-resistant panels, whereby first and second ballistic-resistant panels are not releasably engaged in fixed adjacent relation.
Figures 2C, 2D, 2E, 2F, 2G, 2H:
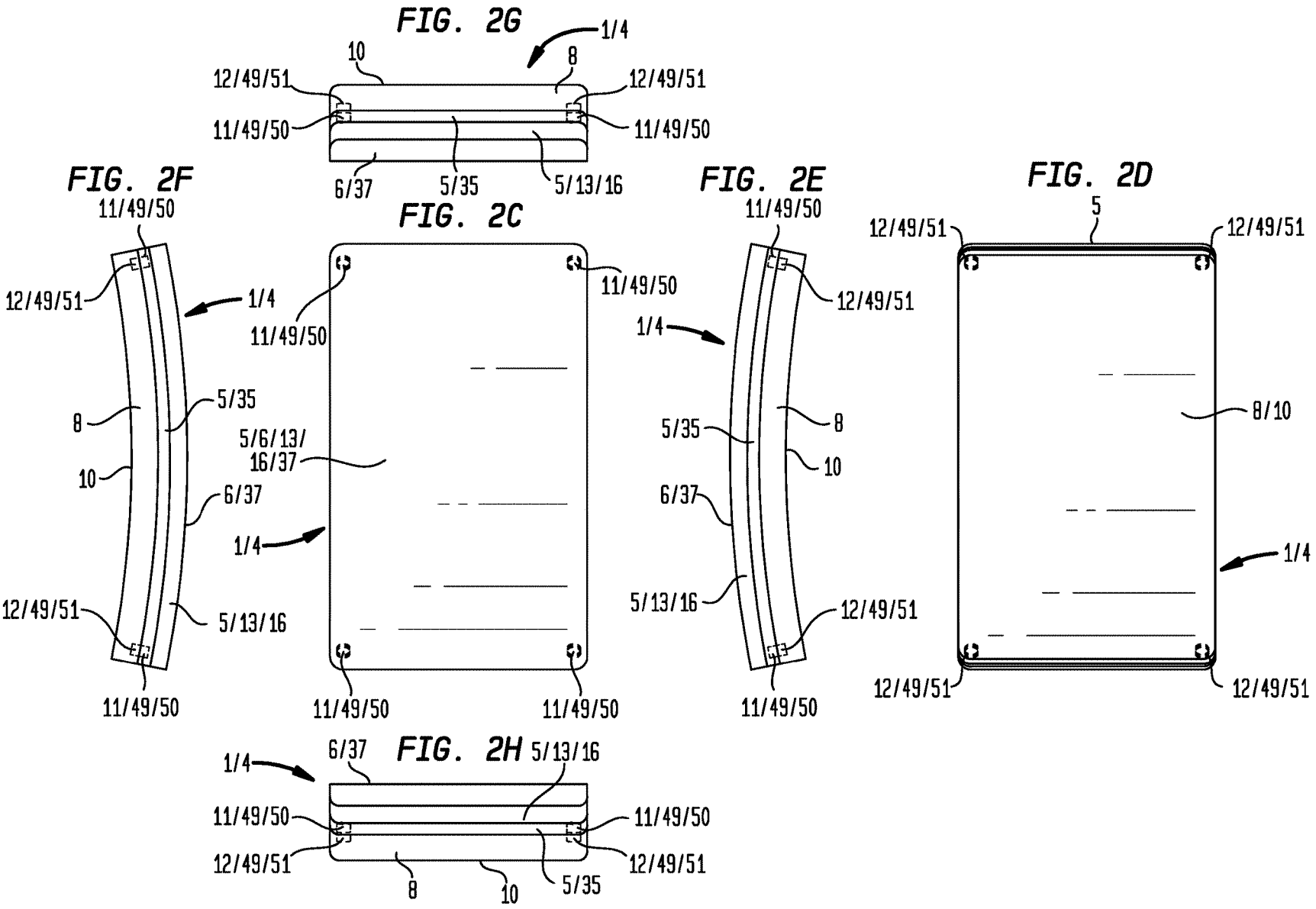
FIG. 2C is a front view of the particular embodiment of the releasably engaged ballistic-resistant panels shown in FIG. 2B.
FIG. 2D is a rear view of the particular embodiment of the releasably engaged ballistic-resistant panels shown in FIG. 2B.
FIG. 2E is a right side view of the particular embodiment of the releasably engaged ballistic-resistant panels shown in FIG. 2B.
FIG. 2F is a left side view of the particular embodiment of the releasably engaged ballistic-resistant panels shown in FIG. 2B.
FIG. 2G is a top view of the particular embodiment of the releasably engaged ballistic-resistant panels shown in FIG. 2B.
FIG. 2H is a bottom view of the particular embodiment of the releasably engaged ballistic-resistant panels shown in FIG. 2B.

The first and second fasteners (11)(12) can releasably engage to fasten the second ballistic-resistant panel front surface (9) to the first ballistic-resistant panel back surface (7) in fixed adjacent relation such that the second ballistic-resistant panel front surface (9) and the first ballistic-resistant panel back surface (7) are precluded from moving away from one another and particularly, are precluded from at least (i) axial movement (41) away from one another, (ii) lateral movement (42) in relation to one another, and (iii) vertical movement (43) in relation to one another (as shown in the example of FIG. 2B), whereby these movements (41)(42)(43) are precluded even after the releasably engaged ballistic-resistant panels (1) have been subjected to one or more ballistic threats.

As to particular embodiments, the fastener (11)(12) can be coupled to the ballistic-resistant panel (5)(8) proximate a ballistic-resistant panel surface (6)(7)(9)(10). As but one illustrative example, the first fastener (11) can be coupled to the first ballistic-resistant panel back surface (7) and specifically, to a backer plate rear surface (44) of the backer plate (35) or a ceramic plate system-backer plate assembly rear surface (45) of the ceramic plate system-backer plate assembly (40), and the second fastener (12) can be coupled to the second ballistic-resistant panel front surface (9), whereby upon releasable engagement of the first and second fasteners (11)(12), the first ballistic-resistant panel back surface (7) and specifically, the backer plate rear surface (44) or the ceramic plate system-backer plate assembly rear surface (45), can be fastened to the second ballistic-resistant panel front surface (9) in fixed adjacent relation.

As to particular embodiments, a plurality of fasteners (11)(12) can be coupled to the ballistic-resistant panel (5)(8) proximate a ballistic-resistant panel surface (6)(7)(9)(10).

As to particular embodiments, a plurality of fasteners (11)(12) can be coupled to the ballistic-resistant panel (5)(8) proximate the ballistic-resistant panel front surface (6)(9). Correspondingly, the ballistic-resistant panel front surface (6)(9) can be fastened to another ballistic-resistant panel (5)(8) with mating fasteners (11)(12) to provide a pair of releasably engaged ballistic-resistant panels (1). As but one illustrative example, a plurality of second fasteners (12) can be coupled to a second ballistic-resistant panel front surface (9).

As to other particular embodiments, a plurality of fasteners (11)(12) can be coupled to the ballistic-resistant panel (5)(8) proximate the ballistic-resistant panel back surface (7)(10). Correspondingly, the ballistic-resistant panel back surface (7)(10) can be fastened to another ballistic-resistant panel (5)(8) with mating fasteners (11)(12) to provide a pair of releasably engaged ballistic-resistant panels (1). As but one illustrative example, a plurality of first fasteners (11) can be coupled to a first ballistic-resistant panel back surface (7).

As to still other particular embodiments, a plurality of fasteners (11)(12) can be coupled to the ballistic-resistant panel (5)(8) proximate both the ballistic-panel front surface (6)(9) and the ballistic-panel back surface (7)(10). Correspondingly, the ballistic-resistant panel front surface (6)(9) can be fastened to another ballistic-resistant panel (5)(8) with mating fasteners (11)(12), and the ballistic-resistant panel back surface (7)(10) can be fastened to an additional ballistic-resistant panel with corresponding mating fasteners to provide at least three releasably engaged ballistic-resistant panels (1), whereby any number of ballistic-resistant panels can have fasteners coupled proximate both the ballistic-resistant panel front and back surfaces such that the process can be repeated any number of times to provide any number of releasably engaged ballistic-resistant panels (1), depending upon the application.

As to particular embodiments, a plurality of fasteners (11)(12) can be coupled to a ballistic-resistant panel surface (6)(7)(9)(10) in spaced apart relation proximate the perimeter (46) of the ballistic-resistant panel (5)(8). Thus, an inner portion (47) of the ballistic-resistant panel (5)(8) can be void of fasteners (11)(12), which may be advantageous if the fasteners (11)(12) lessen one or more ballistic-resistant properties of the portion of the ballistic-resistant panel (5)(8) to which the fasteners (11)(12) couple.

As but one illustrative example, a plurality of first fasteners (11) can be coupled to the first ballistic-resistant panel back surface (7) in spaced apart relation proximate the perimeter (46), whereby at least one first fastener (11) can be coupled proximate each of an upper right portion, an upper left portion, a lower right portion, and a lower left portion of the first ballistic-resistant panel back surface (7), and a plurality of second fasteners (12) can be coupled to the second ballistic-resistant panel front surface (9) in spaced apart relation proximate the perimeter (46), whereby at least one second fastener (12) can be coupled proximate each of an upper right portion, an upper left portion, a lower right portion, and a lower left portion of the second ballistic-resistant panel front surface (9).

The fastener (11)(12) can be any of a numerous and wide variety of fasteners, such as any of a numerous and wide variety of mechanical fasteners, depending upon the application, whereby upon releasable engagement of two fasteners (11)(12), the associated ballistic-resistant panels (5)(8) are fastened in fixed adjacent relation as described above.

Figure 8B:
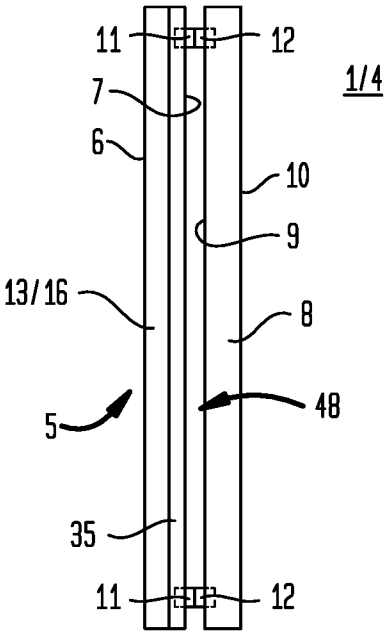
FIG. 8B is a side view of the first and second ballistic-resistant panels shown in FIG. 8A, but whereby the first and second ballistic-resistant panels are releasably engaged in fixed adjacent relation to provide releasably engaged ballistic-resistant panels.
Figure 8A:
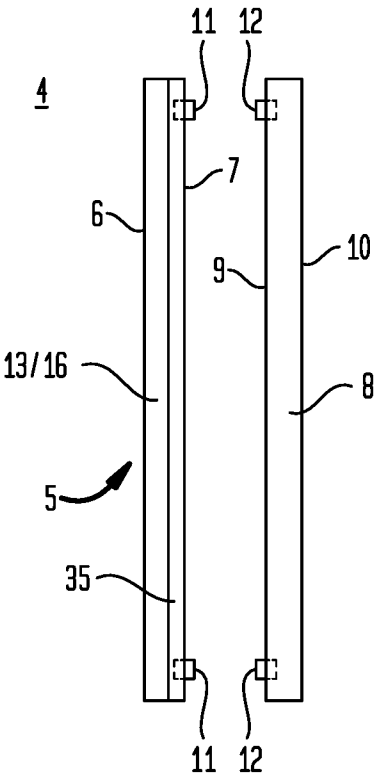
FIG. 8A is a side view of a particular embodiment of the releasably engagable system of ballistic-resistant panels having first and second fasteners which each outwardly extend from a ballistic-resistant panel surface, whereby first and second ballistic-resistant panels are not releasably engaged in fixed adjacent relation.

Now referring primarily to FIG. 8A and FIG. 8B, as to particular embodiments, the fastener (11)(12) can be coupled to a ballistic-resistant panel surface (6)(7)(9)(10) such that at least a portion of the fastener (11)(12) outwardly extends from the ballistic-resistant panel surface (6)(7)(9)(10) and specifically, at least a portion of the fastener (11)(12) outwardly extends from the ballistic-resistant panel surface (6)(7)(9)(10) when first and second fasteners (11)(12) releasably engage to provide the releasably engaged ballistic-resistant panels (1). Accordingly, upon releasable engagement of the first and second fasteners (11)(12), the first ballistic-resistant panel back surface (7) and the second ballistic resistant panel front surface (9) can dispose in spaced apart fixed adjacent relation, thus creating a gap (48), such as an air gap (48), between the first ballistic-resistant panel back surface (7) and the second ballistic resistant panel front surface (9). As to particular embodiments, the air gap (48) created between the first ballistic-resistant panel back surface (7) and the second ballistic resistant panel front surface (9) may enhance the ballistic-resistance of the releasably engaged ballistic-resistant panels (1).

Figure 9B:
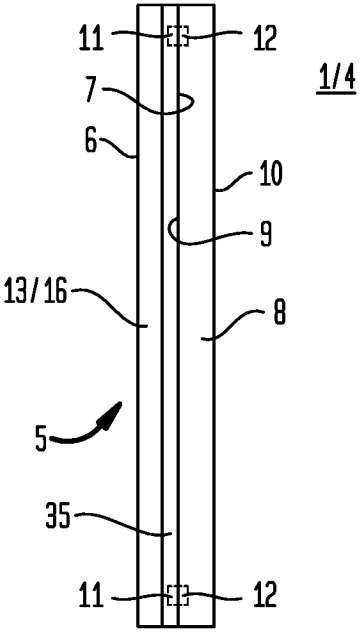
FIG. 9B is a side view of the first and second ballistic-resistant panels shown in FIG. 9A, but whereby the first and second ballistic-resistant panels are releasably engaged in fixed adjacent relation to provide releasably engaged ballistic-resistant panels.
Figure 9A:
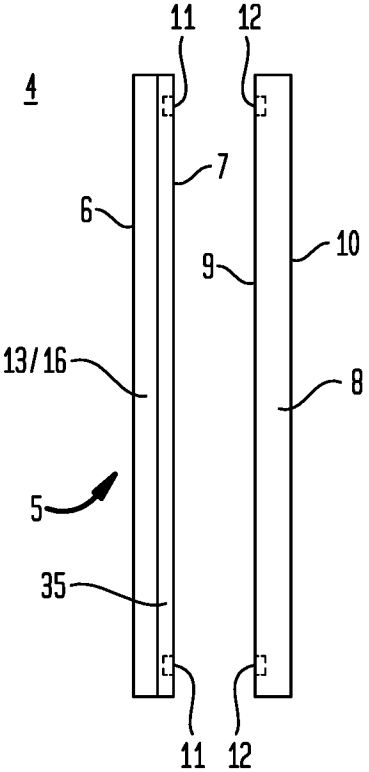
FIG. 9A is a side view of a particular embodiment of the releasably engagable system of ballistic-resistant panels having first and second fasteners which each are inset with a ballistic-resistant panel, whereby first and second ballistic-resistant panels are not releasably engaged in fixed adjacent relation.

Now referring primarily to FIG. 9A and FIG. 9B, as to other particular embodiments, the fastener (11)(12) can be inset within (or inwardly extend into) the ballistic-resistant panel (5)(8) such that the fastener (11)(12) does not outwardly extend from the ballistic-resistant panel surface (6)(7)(9)(10). Thus, upon releasable engagement of the first and second fasteners (11)(12), the first ballistic-resistant panel back surface (7) and the second ballistic resistant panel front surface (9) can dispose in fixed adjacent relation, whereby the first ballistic-resistant panel back surface (7) and the second ballistic-resistant panel front surface (9) can be in contact with one another or nearly in contact with one another, which may enhance the ballistic-resistance of the releasably engaged ballistic-resistant panels (1).

As to particular embodiments, the fastener (11)(12) can, but need not necessarily, be a magnet (49). Accordingly, a first magnet (50) can be coupled to the first ballistic-resistant panel (5) and a second magnet (51) can be coupled to the second ballistic-resistant panel (8), whereby the second magnet (51) is configured to releasably magnetically engage with the first magnet (50) to fasten the second ballistic-resistant panel front surface (9) to the first ballistic-resistant panel back surface (7) in fixed adjacent relation or in spaced apart fixed adjacent relation to provide the releasably magnetically engaged ballistic-resistant panels (1).

The magnet (49) can be any of a numerous and wide variety of magnets, whereby upon releasable magnetic engagement of two magnets (49), the associated ballistic-resistant panels (5)(8) are fastened in fixed adjacent relation or in spaced apart fixed adjacent relation. As but one illustrative example, rare earth magnets made from rare earth elements may be particularly useful with the instant invention.

As but one illustrative example, the magnet (49) can be a disc-type or cylinder-type magnet, as would be familiar to one of ordinary skill in the art. Thus, the magnet (49) can have opposing magnet ends which are substantially planar, allowing for the magnet (49) to be inset within the ballistic-resistant panel (5)(8) such that the magnet (49) does not outwardly extend from the ballistic-resistant panel surface (6)(7)(9)(10). Thus, upon releasable magnetic engagement of first and second magnets (50)(51), the first and second ballistic-resistant panels (5)(8) can dispose in fixed adjacent relation, whereby the first ballistic-resistant panel back surface (7) and the second ballistic-resistant panel front surface (9) can be in contact with one another or nearly in contact with one another (as shown in the example of FIG. 9B), which may enhance the ballistic-resistance of the releasably magnetically engaged ballistic-resistant panels (1).

As to particular embodiments, the fastener (11)(12), such as the magnet (49), can be configured to maintain its fastening properties during production of the ballistic-resistant panel (5)(8). Accordingly, the magnet (49) can be disposed within the ballistic-resistant panel (5)(8), which can then be subjected to heat, pressure, or both for processing as described above, whereby following processing, the magnet (49) maintains its ability to releasably magnetically engage with another magnet (49) to fasten ballistic-resistant panels (5)(8) in fixed adjacent relation or in spaced apart fixed adjacent relation to provide the releasably magnetically engaged ballistic-resistant panels (1).

As but one illustrative example, the magnet (49) can be a neodymium (NdFeB) magnet with a maximum operating temperature of about 150° Celsius, as compared to other magnets having a maximum operating temperature of about 80° Celsius.

As to particular embodiments, the fastener (11)(12), such as the magnet (49), can generate an audible indicium (52) upon releasable magnetic engagement to audibly alert a user that first and second ballistic-resistant panels (5)(8) have releasably magnetically engaged to provide the releasably magnetically engaged ballistic-resistant panels (1), which may afford greater protection against ballistic threats than the first ballistic-resistant panel (5) or the second ballistic-resistant panel (8) provides individually.

As to particular embodiments, the fastener (11)(12), such as the magnet (49), can be directional to allow fastening in a first configuration (53) having a desirable orientation of ballistic-resistant panels (5)(8) and precluding fastening in a second configuration (54) having an undesirable orientation of ballistic-resistant panels (5)(8), which may be advantageous for relatively easily, quickly, and/or correctly releasably magnetically engaging ballistic-resistant panels (5)(8) in fixed adjacent relation to provide the releasably engaged ballistic-resistant panels (1).

Figure 10B:
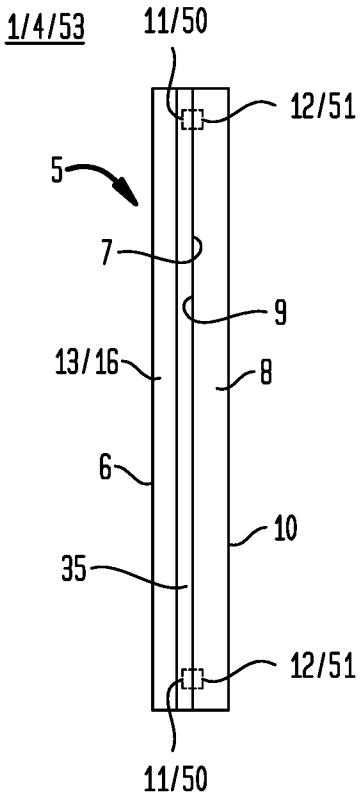
FIG. 10B is a side view of the first and second ballistic-resistant panels shown in FIG. 10A, whereby the first and second ballistic-resistant panels dispose in a first configuration and accordingly, can releasably engage in fixed adjacent relation to provide releasably engaged ballistic-resistant panels.
Figure 10A:
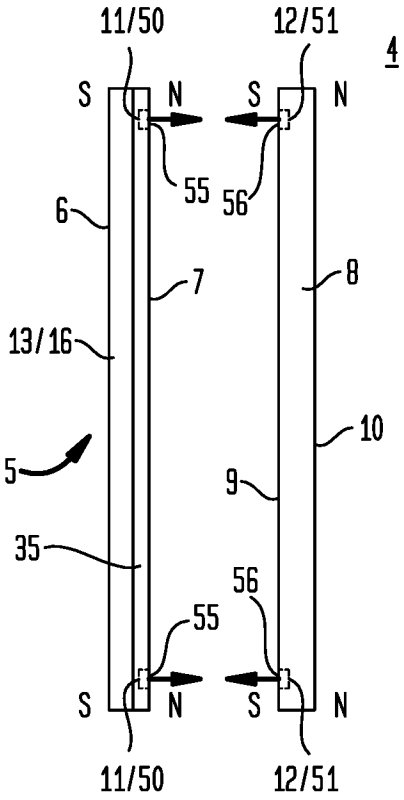
FIG. 10A is a side view of a particular embodiment of the releasably engagable system of ballistic-resistant panels having first and second magnets which are directional to allow fastening in a first configuration and preclude fastening in a second configuration, whereby first and second ballistic-resistant panels are not releasably engaged in fixed adjacent relation.

Now referring primarily to FIG. 10A and FIG. 10B, as but one illustrative example, if a desirable orientation of ballistic-resistant panels (5)(8) comprises a first configuration (53) whereby a second ballistic-resistant panel front surface (9) is fastened to a first ballistic-resistant panel back surface (7), a first magnet (50) can be coupled to the first ballistic-resistant panel (5) such that a first magnet north pole (55) disposes proximate the first ballistic-resistant panel back surface (7) and a second magnet (51) can be coupled to the second ballistic-resistant panel (8) such that a second magnet south pole (56) disposes proximate the second ballistic-resistant panel front surface (9). Correspondingly, the first magnet north pole (55) can releasably magnetically engage with the second magnet south pole (56) via attractive forces to provide the first configuration (53), whereby the second ballistic-resistant panel front surface (9) is fastened to the first ballistic-resistant panel back surface (7) in the desired orientation comprising the first configuration (53) to provide the releasably magnetically engaged ballistic-resistant panels (1).

Now referring primarily to FIG. 11, conversely, upon attempting to dispose the ballistic-resistant panels (5)(8) in an undesirable orientation comprising a second configuration (54) in which a second ballistic-resistant panel back surface (10) disposes proximate a first ballistic-resistant panel back surface (7), the first magnet north pole (55) can repel a second magnet north pole (57) which disposes proximate the second ballistic-resistant panel back surface (10) to preclude disposition of the first and second ballistic-resistant panels (5)(8) in the second configuration (54).

Now referring primarily to FIG. 12A and FIG. 12B, as to other particular embodiments, each fastener (11)(12) can, but need not necessarily, be a component of a hook and loop fastening system (58), such as VELCRO®. Accordingly, a first hook and loop fastening system component (59) comprising hook elements (60) can be coupled to the first ballistic-resistant panel (5) and a second hook and loop fastening system component (61) comprising loop elements (62) can be coupled to the second ballistic-resistant panel (8), whereby the hook elements (60) are configured to releasably hookingly engage with the loop elements (62) to fasten the second ballistic-resistant panel front surface (9) to the first ballistic-resistant panel back surface (7) in fixed adjacent relation or in spaced apart fixed adjacent relation to provide the releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 13A through FIG. 14B, as to other particular embodiments, each fastener (11)(12) can, but need not necessarily, be a component of a post-and-socket fastening system (63).

Now referring primarily to FIG. 13A and FIG. 13B, as but one illustrative example, a first post-and-socket fastening system component (64), such as a post element (65), can be coupled to the first ballistic-resistant panel (5) and a second post-and-socket fastening system component (66), such as a socket element (67), can be inset within the second ballistic-resistant panel (8), whereby the socket element (67) can be configured to insertingly receive the post element (65) for releasable frictional engagement to fasten, for example via snapping, the second ballistic-resistant panel front surface (9) to the first ballistic-resistant panel back surface (7) in fixed adjacent relation or in spaced apart fixed adjacent relation to provide the releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 14A and FIG. 14B, as but a second illustrative example, a socket element (67) can be inset within each of the first and second ballistic resistant panels (5)(8), whereby each socket element (67) can be configured to insertingly receive an opposing end of a discrete post element (65) which is not coupled to either of the first or second ballistic resistant panels (5)(8) or is separate from the first and second ballistic resistant panels (5)(8). Accordingly, upon reception of each opposing end of the post element (65) within the socket elements (67) for releasable frictional engagement, the second ballistic-resistant panel front surface (9) can be fastened to the first ballistic-resistant panel back surface (7) in fixed adjacent relation or in spaced apart fixed adjacent relation to provide the releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 15A and FIG. 15B, another embodiment of the releasably engagable system of ballistic-resistant panels (4) can include an adhesive coating (68) coupled to at least one of the first ballistic-resistant panel back surface (7) or the second ballistic-resistant panel front surface (9), whereby the adhesive coating (68), which may function via mechanical forces and/or electrostatic forces, can be configured to releasably engage the second ballistic-resistant panel front surface (9) with the first ballistic-resistant panel back surface (7) in fixed adjacent relation or in spaced apart fixed adjacent relation to provide releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 16A through FIG. 17B, another embodiment of the releasably engagable system of ballistic-resistant panels (4) can include a securement element (69) discrete from the first and second ballistic-resistant panels (5)(8), whereby the securement element (69) can be configured to releasably secure the second ballistic-resistant panel front surface (9) to the first ballistic-resistant panel back surface (7) in fixed adjacent relation or in spaced apart fixed adjacent relation to provide releasably engaged ballistic-resistant panels (1). Advantageously, the releasably engaged ballistic-resistant panels (1) may afford greater protection against ballistic threats than the first ballistic-resistant panel (5) or the second ballistic-resistant panel (8) provides individually.

Now referring primarily to FIG. 16A and FIG. 16B, as but one illustrative example, the securement element (69) can be configured as a channel (70), for example a C-channel (70), or a clamp (not shown), which can engage with at least one edge (71) of both the first and second ballistic-resistant panels (5)(8) to releasably secure the second ballistic-resistant panel front surface (9) to the first ballistic-resistant panel back surface (7) in fixed adjacent relation or in spaced apart fixed adjacent relation to provide the releasably engaged ballistic-resistant panels (1).

Now referring primarily to FIG. 17A and FIG. 17B, as but a second illustrative example, the securement element (69) can be configured as a resiliently stretchable member (72) which can entirely surround the first and second ballistic-resistant panels (5)(8) in at least one direction, for example horizontally (as shown in the example of FIG. 17B) or vertically (not shown), to releasably secure the second ballistic-resistant panel front surface (9) to the first ballistic-resistant panel back surface (7) in fixed adjacent relation or in spaced apart fixed adjacent relation to provide the releasably engaged ballistic-resistant panels (1).

Ballistic-Resistant Garment

As to particular embodiments, each of the ballistic-resistant panels (5)(8), as well as the releasably engagable system of ballistic-resistant panels (4), can be configured for coupling to a garment (2) to provide a ballistic-resistant garment (3) which may be worn to protect a user from ballistic threats, whereby the coupling can be proximate a garment outer surface, a garment inner surface, or combinations thereof, depending upon the application.

Now referring primarily to FIG. 1 and FIG. 7A through FIG. 7F, as but one illustrative example, each of the ballistic-resistant panels (5)(8), as well as the releasably engagable system of ballistic-resistant panels (4), can be configured for disposition within a garment (2) to provide a ballistic-resistant garment (3) which may be worn to protect a user from ballistic threats.

Accordingly, a pocket (73) can be disposed within the garment (2), whereby the pocket (73) can be configured to receive the releasably engaged ballistic-resistant panels (1) to provide the ballistic-resistant garment (3).

Ballistic-Resistant Panel Dimensions

As to particular embodiments, the ballistic-resistant panel (5)(8) can, but need not necessarily, be contoured, which may be advantageous for disposition of the ballistic-resistant panel (5)(8) or the releasably engaged ballistic-resistant panels (1) within a garment (2) to provide the ballistic-resistant garment (3), whereby the contoured surface may enhance the fit of the ballistic-resistant panel (5)(8) or the releasably engaged ballistic-resistant panels (1) proximate the body of the user.

Figure 4A:
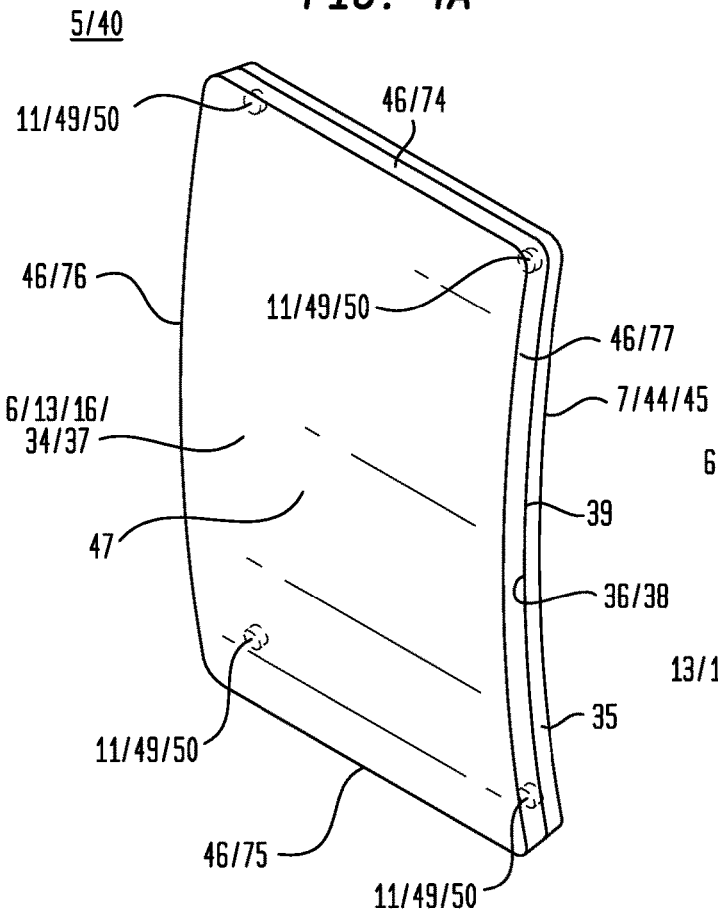
FIG. 4A is a perspective view of a first ballistic-resistant panel of the releasably engagable system of ballistic-resistant panels, whereby the first ballistic-resistant panel includes a ceramic plate system coupled to a backer plate.
Figure 4B:
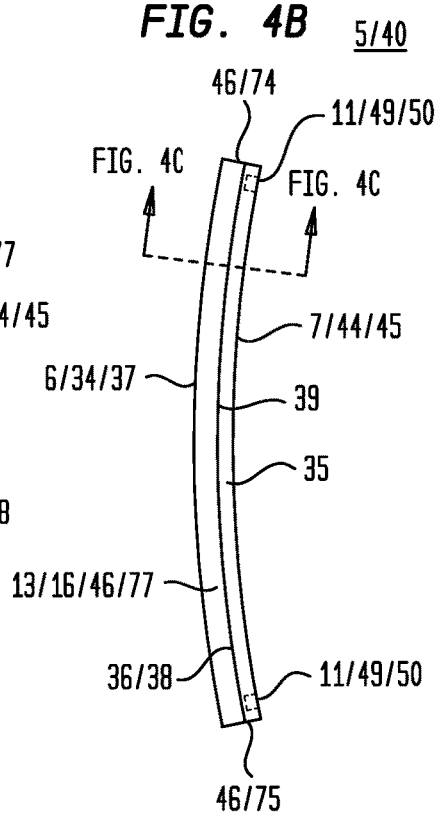
FIG. 4B is a right side view of the particular embodiment of the first ballistic-resistant panel shown in FIG. 4A.
Figure 4C:
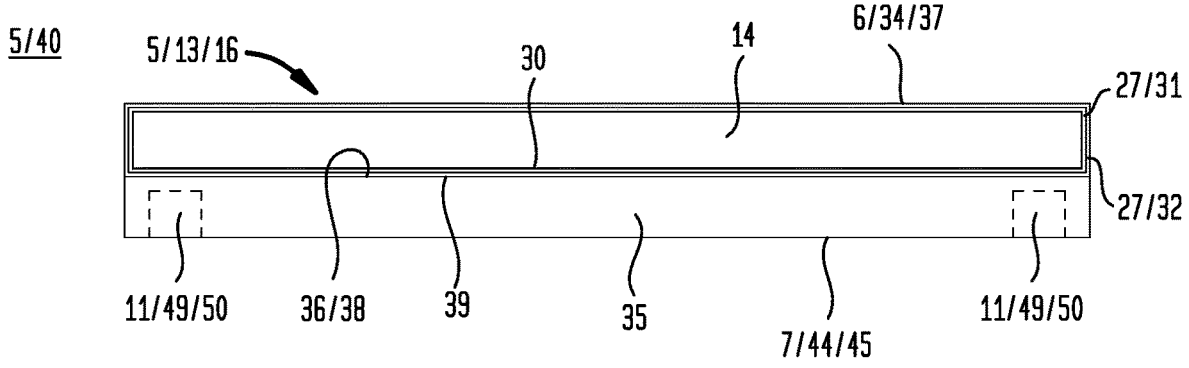
FIG. 4C is a cross-sectional view of the particular embodiment of the first ballistic-resistant panel shown in FIG. 4B, whereby the ceramic plate system includes a ceramic plate surrounded by an adhesive layer surrounded by a first fabric sheet surrounded by a second fabric sheet.
Figure 6B:
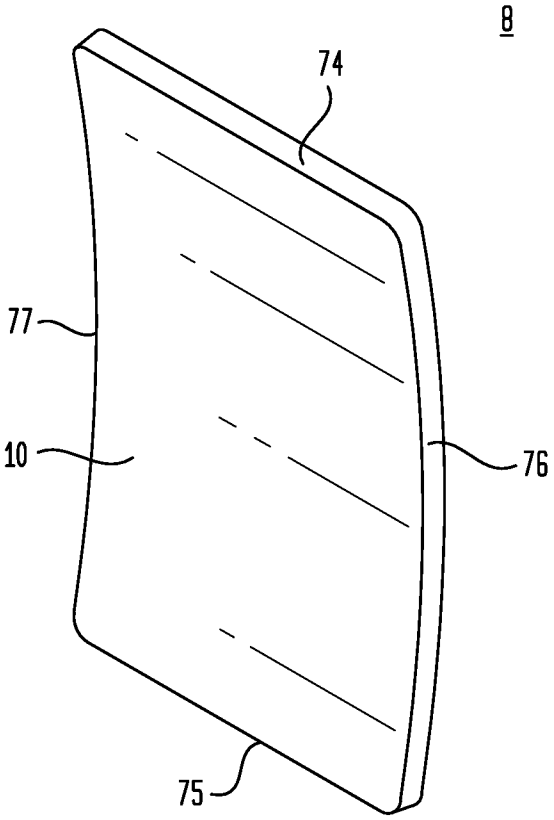
FIG. 6B is a perspective view of a back of the particular embodiment of the second ballistic-resistant panel shown in FIG. 6A.
Figure 6A:
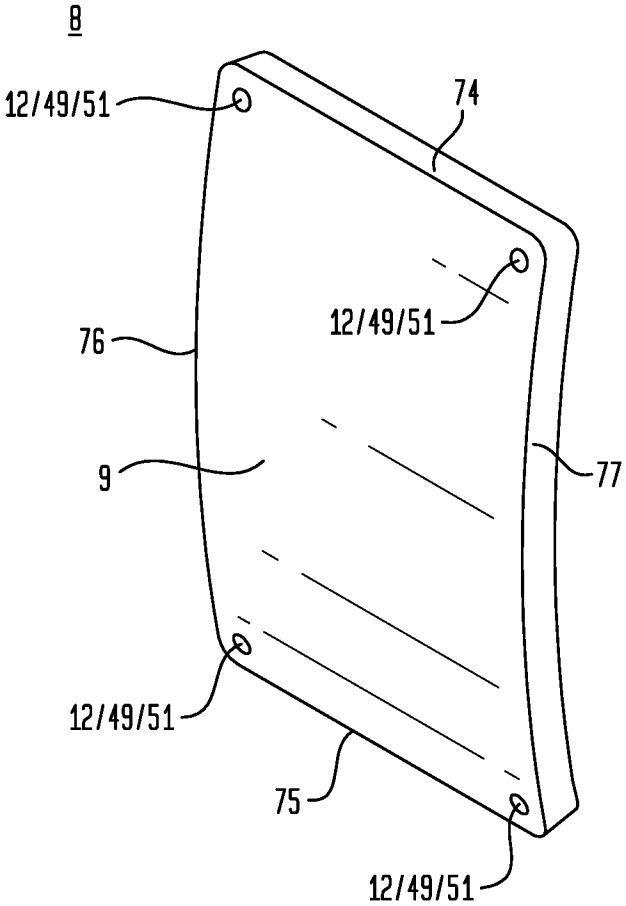
FIG. 6A is a perspective view of a front of a particular embodiment of a second ballistic-resistant panel of the releasably engagable system of ballistic-resistant panels.
Figures 6C, 6D, 6E, 6F, 6G, 6H, 6I:
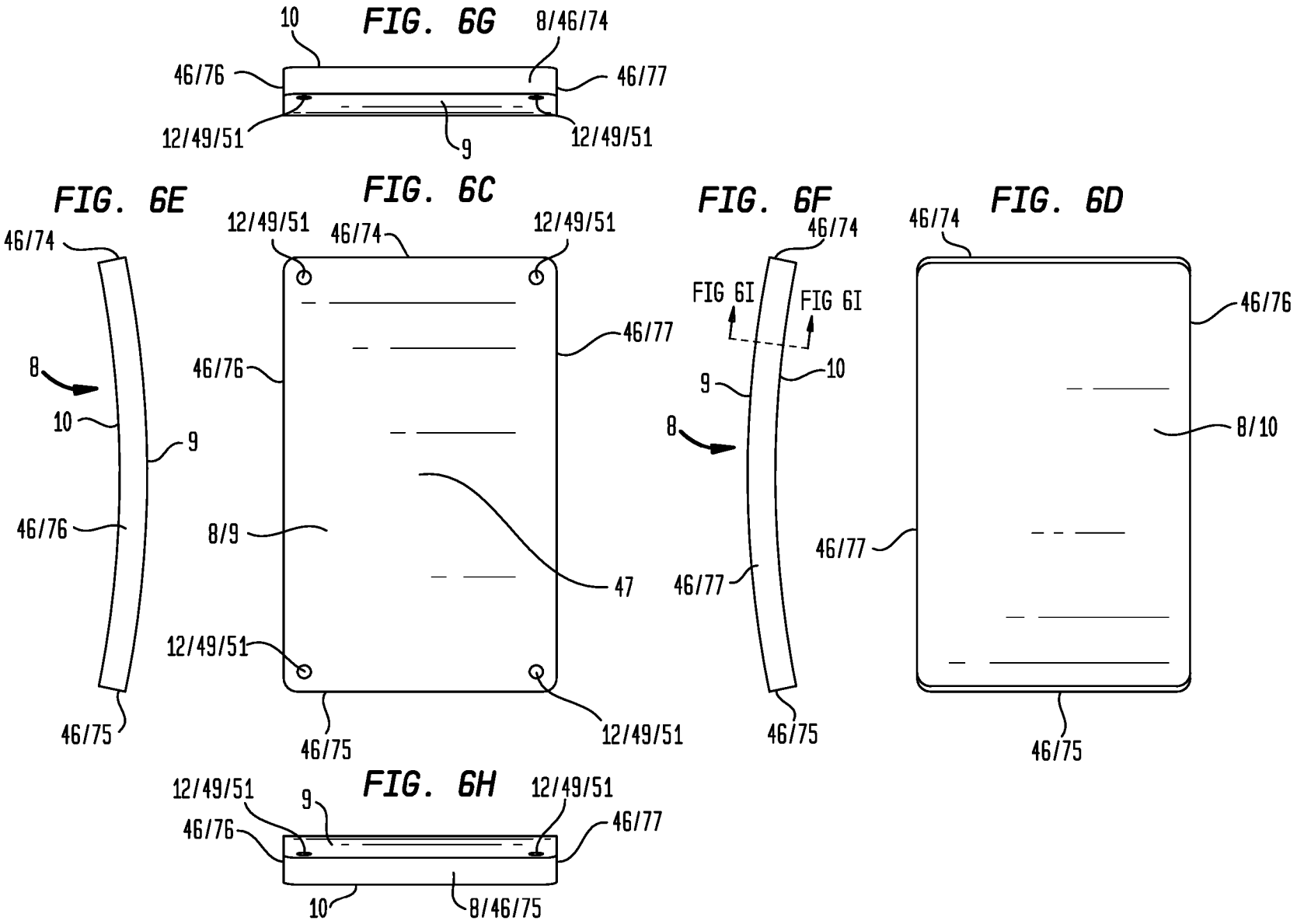
FIG. 6C is a front view of the particular embodiment of the second ballistic-resistant panel shown in FIG. 6A.
FIG. 6D is a rear view of the particular embodiment of the second ballistic-resistant panel shown in FIG. 6A.
FIG. 6E is a left side view of the particular embodiment of the second ballistic-resistant panel shown in FIG. 6A.
FIG. 6F is a right side view of the particular embodiment of the second ballistic-resistant panel shown in FIG. 6A.
FIG. 6G is a top view of the particular embodiment of the second ballistic-resistant panel shown in FIG. 6A.
FIG. 6H is a bottom view of the particular embodiment of the second ballistic-resistant panel shown in FIG. 6A.
FIG. 6I is a cross-sectional view of the particular embodiment of the second ballistic-resistant panel shown in FIG. 6F, whereby a plurality of ballistic-resistant fabric sheets form the second ballistic-resistant panel.
Figure 6I:
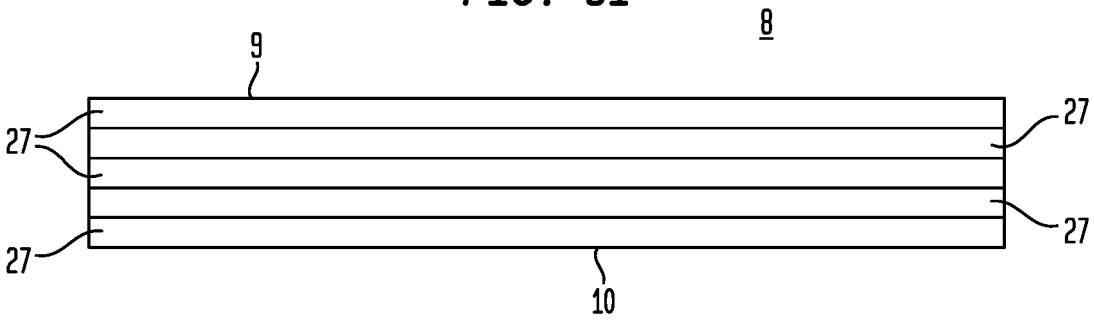
Figure 7A:
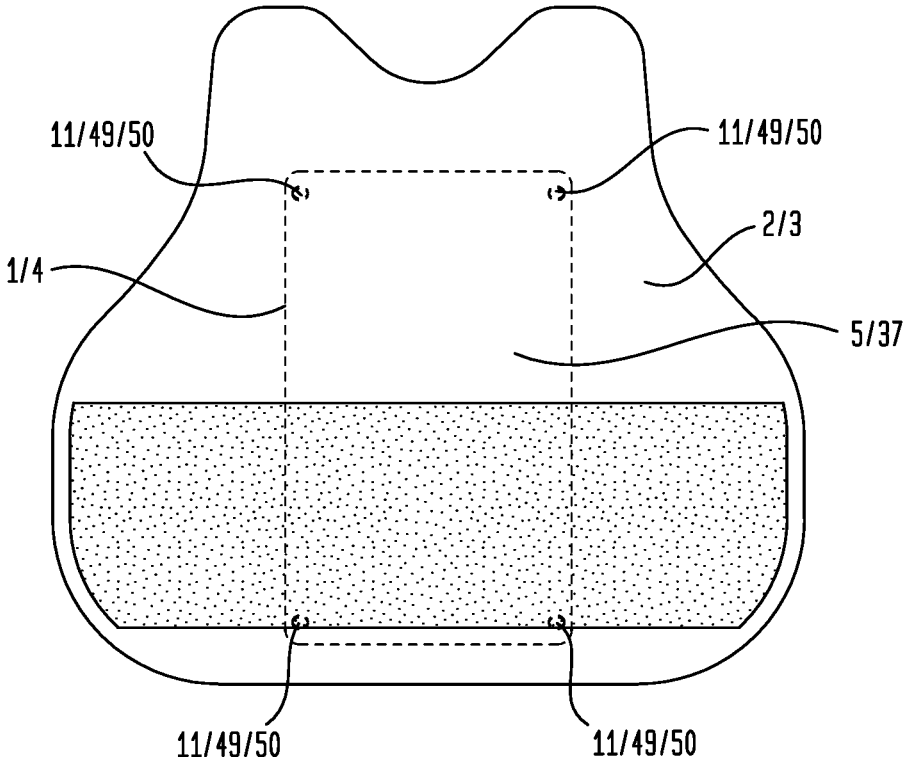
FIG. 7A is a front view of a garment in which releasably engaged ballistic-resistant panels are disposed to provide a ballistic-resistant garment.
Figure 7B:
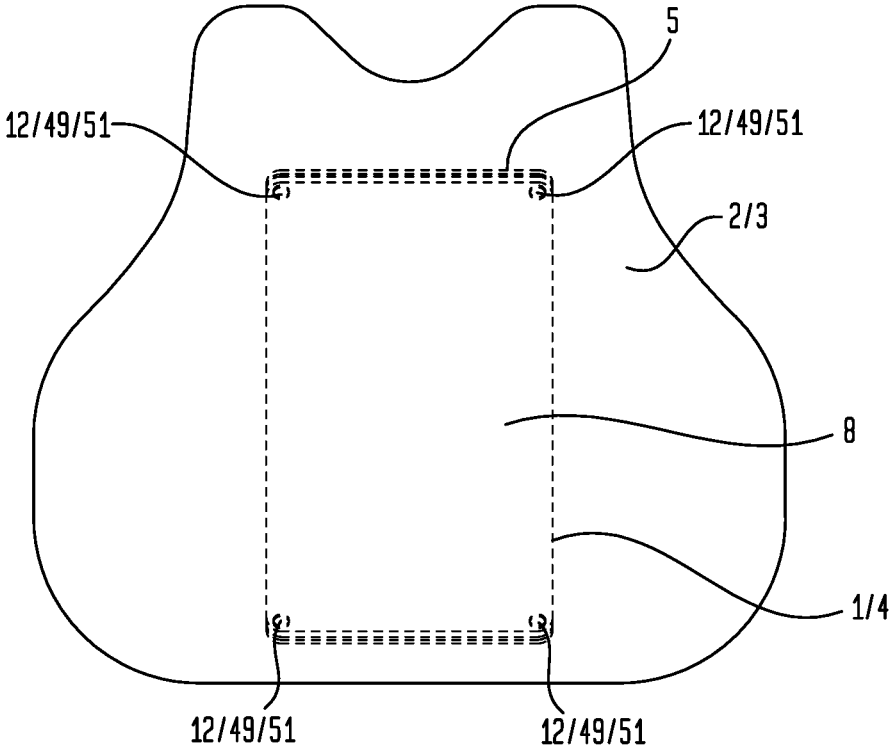
FIG. 7B is a rear view of the ballistic-resistant garment shown in FIG. 7A.
Figure 7C:
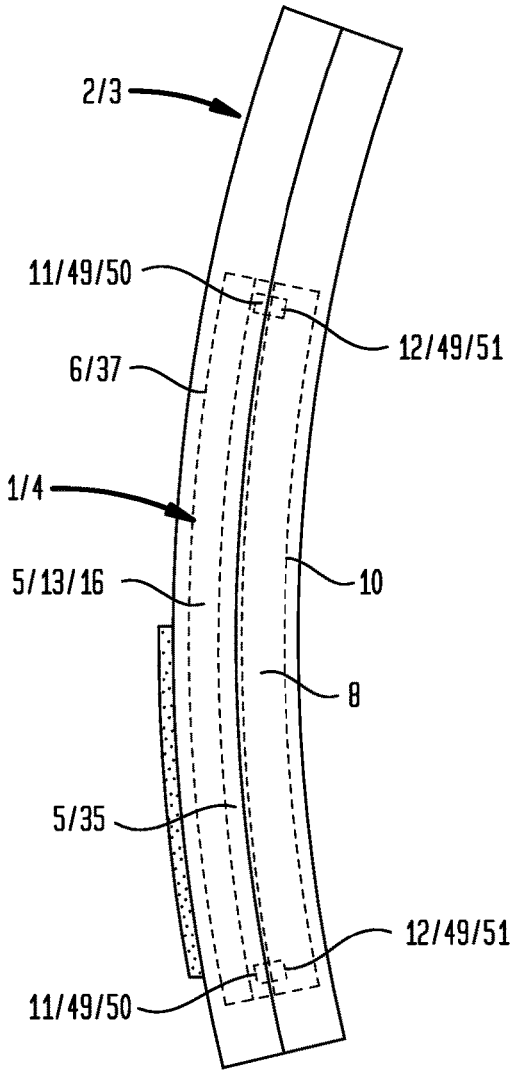
FIG. 7C is a right side view of the ballistic-resistant garment shown in FIG. 7A.
Figure 7D:
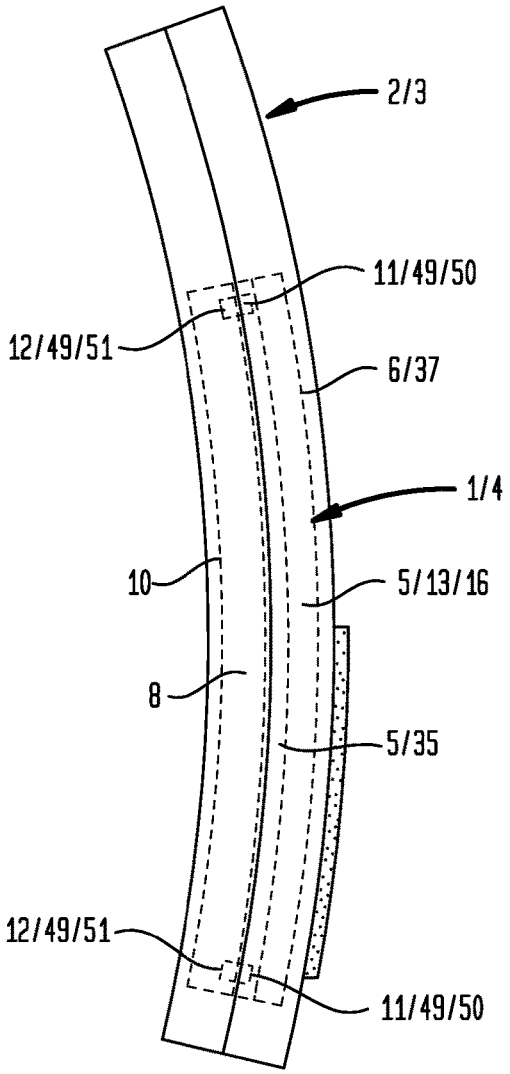
FIG. 7D is a left side view of the ballistic-resistant garment shown in FIG. 7A.
Figure 7E:
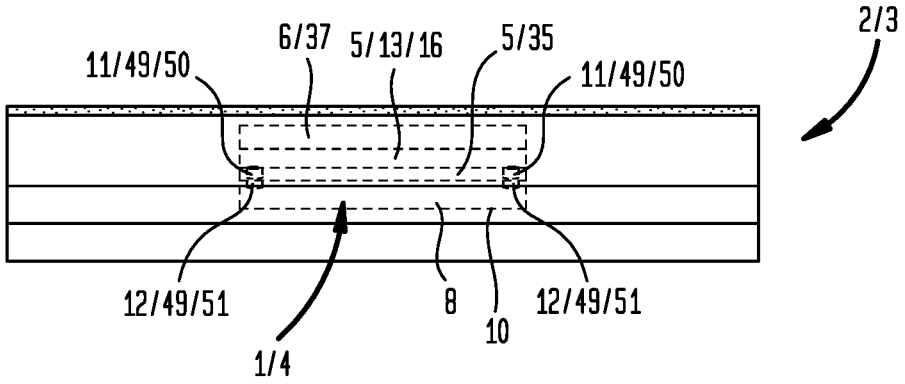
FIG. 7E is a top view of the ballistic-resistant garment shown in FIG. 7A.
Figure 7F:
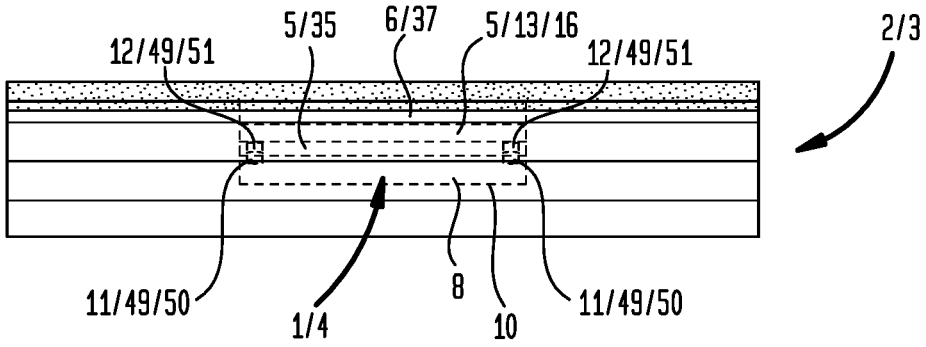
FIG. 7F is a bottom view of the ballistic-resistant garment shown in FIG. 7A.

Now referring primarily to FIG. 4A, FIG. 4B, and FIG. 6C, the ballistic-resistant panel (5)(8) can have a length disposed between first and second ends (74)(75) and a width disposed between first and second sides (76)(77), whereby the ballistic-resistant panel (5)(8) can be arcuate along the length and/or the width to enhance the fit of the ballistic-resistant panel (5)(8) or the releasably engaged ballistic-resistant panels (1) proximate the body of the user.

Each of the first and second ballistic-resistant panels (5)(8) can have a numerous and wide variety of thicknesses, depending upon the thickness of the ceramic plate system (13) and the plurality of ballistic-resistant fabric sheets (27), respectively.

Now referring primarily to FIG. 3I, as but one illustrative example, the ceramic plate system (13) can include a ceramic plate (14) having a thickness of about 0.300 inches, an adhesive layer (18) having a thickness of about 0.002 inches, an aramid fiber first fabric sheet (31) having a thickness of about 0.018 inches, and a carbon fiber second fabric sheet (32) having a thickness of about 0.018 inches. Further, the ceramic plate system (13) can be coupled to a backer plate (35) having a thickness of about 0.225 inches. Additionally, the plurality of ballistic-resistant fabric sheets (27) which provide the second ballistic-resistant panel (8) can have a thickness of about 0.560 inches.

Method of Making

A method of making an embodiment of the releasably engagable system of ballistic-resistant panels (4) includes providing a first ballistic-resistant panel (5) comprising a ceramic plate system (13), the first ballistic-resistant panel (5) having opposing first ballistic-resistant panel front and back surfaces (6)(7); providing a second ballistic-resistant panel (8) having opposing second ballistic-resistant panel front and back surfaces (9)(10); coupling a first fastener (11) to the first ballistic-resistant panel (5); and coupling a second fastener (12) to the second ballistic-resistant panel (8), whereby the second fastener (12) is configured to releasably engage with the first fastener (11) to fasten the second ballistic-resistant panel front surface (9) to the first ballistic-resistant panel back surface (7) in fixed adjacent relation to provide the releasably engaged ballistic-resistant panels (1).

A method of making another embodiment of the releasably engagable system of ballistic-resistant panels (4) includes providing a first ballistic-resistant panel (5) comprising a ceramic plate system (13), the first ballistic-resistant panel (5) having opposing first ballistic-resistant panel front and back surfaces (6)(7); providing a second ballistic-resistant panel (8) having opposing second ballistic-resistant panel front and back surfaces (9)(10); and coupling an adhesive coating (68) to at least one of the first ballistic-resistant panel back surface (7) or the second ballistic-resistant panel front surface (9), whereby the adhesive coating (68) functions to releasably engage the second ballistic-resistant panel front surface (9) with the first ballistic-resistant panel back surface (7) in fixed adjacent relation to provide releasably engaged ballistic-resistant panels (1).

A method of making another embodiment of the releasably engagable system of ballistic-resistant panels (4) includes providing a first ballistic-resistant panel (5) comprising a ceramic plate system (13), the first ballistic-resistant panel (5) having opposing first ballistic-resistant panel front and back surfaces (6)(7); providing a second ballistic-resistant panel (8) having opposing second ballistic-resistant panel front and back surfaces (9)(10); and providing a securement element (69) discrete from the first and second ballistic-resistant panels (5)(8), whereby the securement element (69) is configured to releasably secure the second ballistic-resistant panel front surface (9) to the first ballistic-resistant panel back surface (7) in fixed adjacent relation to provide releasably engaged ballistic-resistant panels (1).

The method of making the various embodiments of the releasably engagable system of ballistic-resistant panels (4) can further include providing additional components as described above and in the claims.

Method of Using

A method of using an embodiment of the releasably engagable system of ballistic-resistant panels (4) includes obtaining the releasably engagable system of ballistic-resistant panels (4) comprising: a first ballistic-resistant panel (5) comprising a ceramic plate system (13), the first ballistic-resistant panel (5) having opposing first ballistic-resistant panel front and back surfaces (6)(7), a second ballistic-resistant panel (8) having opposing second ballistic-resistant panel front and back surfaces (9)(10), a first fastener (11) coupled to the first ballistic-resistant panel (5), and a second fastener (12) coupled to the second ballistic-resistant panel (8); and releasably engaging the second fastener (12) with the first fastener (11) to fasten the second ballistic-resistant panel front surface (9) to the first ballistic-resistant panel back surface (7) in fixed adjacent relation to provide the releasably engaged ballistic-resistant panels (1).

A method of using another embodiment of the releasably engagable system of ballistic-resistant panels (4) includes obtaining the releasably engagable system of ballistic-resistant panels (4) comprising: a first ballistic-resistant panel (5) comprising a ceramic plate system (13), the first ballistic-resistant panel (5) having opposing first ballistic-resistant panel front and back surfaces (6)(7), a second ballistic-resistant panel (8) having opposing second ballistic-resistant panel front and back surfaces (9)(10), and an adhesive coating (68) coupled to at least one of the first ballistic-resistant panel back surface (7) or the second ballistic-resistant panel front surface (9); and releasably adhering the first and second ballistic-resistant panels (5)(8) together via the adhesive coating (68) to fasten the second ballistic-resistant panel front surface (9) to the first ballistic-resistant panel back surface (7) in fixed adjacent relation to provide the releasably engaged ballistic-resistant panels (1).

A method of using another embodiment of the releasably engagable system of ballistic-resistant panels (4) includes obtaining the releasably engagable system of ballistic-resistant panels (4) comprising: a first ballistic-resistant panel (5) comprising a ceramic plate system (13), the first ballistic-resistant panel (5) having opposing first ballistic-resistant panel front and back surfaces (6)(7), a second ballistic-resistant panel (8) having opposing second ballistic-resistant panel front and back surfaces (9)(10), and a securement element (69) discrete from the first and second ballistic-resistant panels (5)(8); and releasably securing the first and second ballistic-resistant panels (5)(8) together via the securement element (69) to fasten the second ballistic-resistant panel front surface (9) to the first ballistic-resistant panel back surface (7) in fixed adjacent relation to provide the releasably engaged ballistic-resistant panels (1).

The method of using the various embodiments of the releasably engagable system of ballistic-resistant panels (4) can further include additional actions as described above and in the claims.

As can be easily understood from the foregoing, the basic concepts of the present invention may be embodied in a variety of ways. The invention involves numerous and varied embodiments of a releasably engagable system of ballistic-resistant panels and methods for making and using such a releasably engagable system of ballistic-resistant panels, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a user (2) of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant(s) should be understood to claim at least: i) each of the releasably engagable systems of ballistic-resistant panels herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A releasably engagable system of ballistic-resistant panels comprising:

a first ballistic-resistant panel comprising a ceramic plate system, said first ballistic-resistant panel having opposing first ballistic-resistant panel front and back surfaces;

a second ballistic-resistant panel formed from a plurality of ballistic-resistant fabric sheets, said second ballistic-resistant panel having opposing second ballistic-resistant panel front and back surfaces;

wherein said second ballistic-resistant panel is classified as Type II or Type IIIA or Type III or Type IV armor in compliance with NIJ Standard-0101.06 (July 2008 Edition);

a plurality of first fasteners coupled to said first ballistic-resistant panel proximate a first ballistic-resistant panel perimeter, at least one said first fastener coupled proximate an upper portion of said first ballistic resistant panel perimeter and at least one said first fastener coupled proximate a lower portion of said first ballistic resistant panel perimeter; and a plurality of second fasteners coupled to said second ballistic-resistant panel proximate a second ballistic-resistant panel perimeter, at least one said second fastener coupled proximate an upper portion of said second ballistic resistant panel perimeter and at least one said second fastener coupled proximate a lower portion of said second ballistic resistant panel perimeter, said second fasteners configured to releasably engage with said first fasteners to fasten said second ballistic-resistant panel front surface to said first ballistic-resistant panel back surface in fixed adjacent relation to provide releasably engaged ballistic-resistant panels;

wherein a first ballistic-resistant panel inner portion and a second ballistic-resistant panel inner portion are void of corresponding said first and second fasteners;

wherein in said fixed adjacent relation, said first and second ballistic-resistant panels are precluded from (i) axial movement away from one another, (ii) lateral movement in relation to one another, and (iii) vertical movement in relation to one another upon subjection to one or more ballistic threats.

2. The releasably engagable system of ballistic-resistant panels of claim 1, wherein said ceramic plate system comprises a ceramic plate separately encased in a containment layer to provide an encased ceramic plate; and wherein said encased ceramic plate is configured to releasably engage with said second ballistic-resistant panel.

3. The releasably engagable system of ballistic-resistant panels of claim 2, wherein said first fasteners are coupled to said containment layer.

4. The releasably engagable system of ballistic-resistant panels of claim 1, wherein said first fasteners are coupled to said first ballistic-resistant panel back surface in spaced apart relation proximate said first ballistic-resistant panel perimeter, and said second fasteners are coupled to said second ballistic-resistant panel front surface in spaced apart relation proximate said second ballistic-resistant panel perimeter.

5. The releasably engagable system of ballistic-resistant panels of claim 1, wherein each said ballistic-resistant fabric sheet comprises a plurality of fibers bonded by a resin.

6. The releasably engagable system of ballistic-resistant panels of claim 1, wherein said ballistic-resistant fabric sheets are formed from a material selected from the group consisting of: fiberglass, aramid fibers, para-aramid fibers, meta-aramid fibers, polyolefins, and thermoplastic polyethylenes.

7. The releasably engagable system of ballistic-resistant panels of claim 1, wherein said ballistic-resistant fabric sheets comprise ultra-high-molecular-weight polyethylenes.

8. The releasably engagable system of ballistic-resistant panels of claim 1, wherein said first and second ballistic-resistant panels dispose within a garment to provide a ballistic-resistant garment.

9. The releasably engagable system of ballistic-resistant panels of claim 8, wherein said first and second ballistic-resistant panels dispose within a pocket of said garment.

10. A releasably engagable system of ballistic-resistant panels comprising:

a first ballistic-resistant panel comprising a ceramic plate system, said first ballistic-resistant panel having opposing first ballistic-resistant panel front and back surfaces;

a second ballistic-resistant panel formed from a plurality of ballistic-resistant fabric sheets, said second ballistic-resistant panel having opposing second ballistic-resistant panel front and back surfaces;

wherein said second ballistic-resistant panel is classified as Type II or Type IIIA or Type III or Type IV armor in compliance with NIJ Standard-0101.06 (July 2008 Edition);

wherein said first and second ballistic-resistant panels are configured for disposition within a pocket of a garment to provide a ballistic-resistant garment;

a plurality of first fasteners coupled to said first ballistic-resistant panel proximate a first ballistic-resistant panel perimeter, at least one said first fastener coupled proximate an upper portion of said first ballistic resistant panel perimeter and at least one said first fastener coupled proximate a lower portion of said first ballistic resistant panel perimeter; and a plurality of second fasteners coupled to said second ballistic-resistant panel proximate a second ballistic-resistant panel perimeter, at least one said second fastener coupled proximate an upper portion of said second ballistic resistant panel perimeter and at least one said second fastener coupled proximate a lower portion of said second ballistic resistant panel perimeter;

wherein a first ballistic-resistant panel inner portion and a second ballistic-resistant panel inner portion are void of corresponding said first and second fasteners; and wherein said second fasteners are configured to releasably engage with said first fasteners to fasten said second ballistic-resistant panel front surface to said first ballistic-resistant panel back surface in fixed adjacent relation to provide releasably engaged ballistic-resistant panels.

11. The releasably engagable system of ballistic-resistant panels of claim 10, wherein said first and second ballistic-resistant panels are configured for coupling to a garment to provide a ballistic-resistant garment for protecting a front torso of a wearer from ballistic threats; and wherein when worn, a ballistic-resistant garment inner portion which protects a majority of said front torso is void of corresponding said first and second fasteners.

12. A releasably engagable system of ballistic-resistant panels, comprising:

a first ballistic-resistant panel comprising a ceramic plate system, said first ballistic-resistant panel having opposing first ballistic-resistant panel front and back surfaces;

a second ballistic-resistant panel formed from a plurality of anti-ballistic sheets, said second ballistic-resistant panel having opposing second ballistic-resistant panel front and back surfaces; wherein said second ballistic-resistant panel is classified as Type II or Type IIIA or Type III or Type IV armor in compliance with NIJ Standard-0101.06 (July 2008 Edition); wherein said first and second ballistic-resistant panels are configured for disposition within a pocket of a garment to provide a ballistic-resistant garment;

a plurality of first fasteners directly coupled to said first ballistic-resistant panel proximate a first ballistic-resistant panel perimeter, at least one said first fastener coupled proximate an upper portion of said first ballistic resistant panel perimeter and at least one said first fastener coupled proximate a lower portion of said first ballistic resistant panel perimeter; and a plurality of second fasteners directly coupled to said second ballistic-resistant panel proximate a second ballistic-resistant panel perimeter, at least one said second fastener coupled proximate an upper portion of said second ballistic resistant panel perimeter and at least one said second fastener coupled proximate a lower portion of said second ballistic resistant panel perimeter;

wherein said second fasteners are configured to releasably engage with said first fasteners to fasten said second ballistic-resistant panel front surface to said first ballistic-resistant panel back surface in fixed adjacent relation to provide releasably engaged ballistic-resistant panels; and said first and second fasteners are selected from the group consisting of: magnets, a hook and loop fastening system, and a releasable post-and-socket fastening system.

13. The releasably engagable system of ballistic-resistant panels of claim 12, wherein said first and second fasteners are selected from the group consisting of: magnets and a hook and loop fastening system.

14. The releasably engagable system of ballistic-resistant panels of claim 12, wherein said first and second fasteners comprise a hook and loop fastening system.

15. A releasably engagable system of ballistic-resistant panels, comprising:

a first ballistic-resistant panel comprising a ceramic plate system, said first ballistic-resistant panel having opposing first ballistic-resistant panel front and back surfaces;

a second ballistic-resistant panel consisting of a plurality of anti-ballistic sheets and resin, said second ballistic-resistant panel having opposing second ballistic-resistant panel front and back surfaces; wherein said second ballistic-resistant panel is classified as Type II or Type IIIA or Type III or Type IV armor in compliance with NIJ Standard-0101.06 (July 2008 Edition); wherein said first and second ballistic-resistant panels are configured for disposition within a pocket of a garment to provide a ballistic-resistant garment;

a plurality of first fasteners coupled to said first ballistic-resistant panel proximate a first ballistic-resistant panel perimeter, at least one said first fastener coupled proximate an upper portion of said first ballistic resistant panel perimeter and at least one said first fastener coupled proximate a lower portion of said first ballistic resistant panel perimeter; and a plurality of second fasteners coupled to said second ballistic-resistant panel proximate a second ballistic-resistant panel perimeter, at least one said second fastener coupled proximate an upper portion of said second ballistic resistant panel perimeter and at least one said second fastener coupled proximate a lower portion of said second ballistic resistant panel perimeter;

wherein a first ballistic-resistant panel inner portion and a second ballistic-resistant panel inner portion are void of corresponding said first and second fasteners; and wherein said second fasteners are configured to releasably engage with said first fasteners to fasten said second ballistic-resistant panel front surface to said first ballistic-resistant panel back surface in fixed adjacent relation to provide releasably engaged ballistic-resistant panels.

16. A releasably engagable system of ballistic-resistant panels comprising:

a first ballistic-resistant panel formed from a plurality of anti-ballistic sheets, said first ballistic-resistant panel having opposing first ballistic-resistant panel front and back surfaces;

a second ballistic-resistant panel formed from a plurality of ballistic-resistant sheets, said second ballistic-resistant panel having opposing second ballistic-resistant panel front and back surfaces;

wherein said second ballistic-resistant panel is classified as Type II or Type IIIA or Type III or Type IV armor in compliance with NIJ Standard-0101.06 (July 2008 Edition);

a plurality of first fasteners coupled to said first ballistic-resistant panel proximate a first ballistic-resistant panel perimeter, at least one said first fastener coupled proximate an upper portion of said first ballistic resistant panel perimeter and at least one said first fastener coupled proximate a lower portion of said first ballistic resistant panel perimeter; and a plurality of second fasteners coupled to said second ballistic-resistant panel proximate a second ballistic-resistant panel perimeter, at least one said second fastener coupled proximate an upper portion of said second ballistic resistant panel perimeter and at least one said second fastener coupled proximate a lower portion of said second ballistic resistant panel perimeter, said second fasteners configured to releasably engage with said first fasteners to fasten said second ballistic-resistant panel front surface to said first ballistic-resistant panel back surface in fixed adjacent relation to provide releasably engaged ballistic-resistant panels;

wherein a first ballistic-resistant panel inner portion and a second ballistic-resistant panel inner portion are void of corresponding said first and second fasteners;

wherein in said fixed adjacent relation, said first and second ballistic-resistant panels are precluded from (i) axial movement away from one another, (ii) lateral movement in relation to one another, and (iii) vertical movement in relation to one another upon subjection to one or more ballistic threats.

* * * * *